US005547192A

United States Patent [19]

Ishibashi

[11] Patent Number: 5,547,192

[45] Date of Patent: Aug. 20, 1996

[54] DISPLAY APPARATUS FOR GAMING MACHINE

[75] Inventor: Kazuyoshi Ishibashi, Tokyo, Japan

[73] Assignee: Universal Sales Co., Ltd., Tokyo, Japan

[21] Appl. No.: 229,015

[22] Filed: Apr. 18, 1994

[30] Foreign Application Priority Data

Apr. 16, 1993 [JP] Japan ..... 5-090082

[51] Int. Cl.[6] ..... A63F 9/24

[52] U.S. Cl. ..... 463/26; 463/29; 463/21

[58] Field of Search ..... 273/138 A, 121 B, 273/142 R, 143 R

[56] References Cited

U.S. PATENT DOCUMENTS

| | | | |
|---|---|---|---|
| 4,006,904 | 2/1977 | Felsher | 273/138 A |
| 4,624,459 | 11/1986 | Kaufman | 273/138 A X |
| 4,837,728 | 6/1989 | Barrie et al. | 273/138 A X |
| 4,993,713 | 2/1991 | Harada | 273/138 A |

FOREIGN PATENT DOCUMENTS

| | | | |
|---|---|---|---|
| 2734903 | 2/1979 | Germany | 273/138 A |
| 3738120 | 5/1989 | Germany | 273/138 A |
| 4-343874 | 11/1992 | Japan . | |
| 2170636 | 8/1986 | United Kingdom | 273/143 R |
| 2181589 | 4/1987 | United Kingdom | 273/143 R |
| 2204436 | 11/1988 | United Kingdom | 273/138 A |
| 2222712 | 3/1990 | United Kingdom | 273/143 R |
| 2242300 | 9/1991 | United Kingdom | 273/138 A |

*Primary Examiner*—Jessica J. Harrison
*Assistant Examiner*—Michael O'Neill
*Attorney, Agent, or Firm*—Young & Thompson

[57] ABSTRACT

In a slot machine, a token is inserted to play a game. The slot machine pays tokens when the game results in a win, which comprises a normal win, or a big win for which more tokens are paid than for the normal win. The game comprises a normal game, or a bonus game whose winning probability is higher than the normal game. The bonus game is triggered when a big win is acquired. The slot machine generates a play signal representing a play of the game and a big win signal representing a big win. A display apparatus is associated with the slot machine, and has 16 DIP switches which are set with reference to the slot machine, and signal information regarding the slot machine. In the display apparatus, a normal game counter counts the times of having played the normal game between the completion of playing the bonus game and the occurrence of a big win, whereas a big win counter counts the number of times of a big win. A microcomputer receives the information from DIP switches, and causes 4-digit and 2-digit LEDs responsively to display the count values of the two counters. In a microcomputer, a subtracter calculates a net reward number of tokens rewarded by the slot machine. While playing the bonus game, the LEDs display the net reward number. The same display apparatus is adaptable to a pinball machine in which a ball is bet to play a game, and operates similarly.

20 Claims, 21 Drawing Sheets

| FIG. 4A | FIG. 4B |
|---|---|

DISPLAY APPARATUS FOR GAMING MACHINE

BACKGROUND OF THE INVENTION

1. Field of the Invention

The present invention relates to a display apparatus for use with a gaming machine such as a slot machine or a pinball machine. More particularly, the present invention relates to a display apparatus conveniently adaptable to two or more kinds of gaming machines.

2. Description of the Prior Art

A gaming hall such as a casino or the like contains a great number of gaming machines such as pinball machines and slot machines. A pinball machine uses steel balls as its play media. A slot machine uses tokens including coins as its play media.

Each pinball machine, of an upright type called "pachinko", incorporates a board on which balls move downward and has a number of win holes, an advantage hole, and a loss hole. When balls to be played are shot, they fall by gravity down the front of the board. If a ball enters one of the win holes or the advantage hole, a player acquires a win. When the ball enters the advantage hole, a bonus winning display is triggered to appear for a predetermined period, after which the bonus winning display shows a fixes pattern determined at random. If the pattern as shown coincides with a specific winning pattern as preset, it is judged to give the player a big win. The pinball machine has a normally closed operable big win receiver, called an "attacker" in the pinball machine art. As soon as a big win occurs, the big win receiver is driven to be fully open as a "bonus", so as to receive a much greater number of balls than the win holes and the advantage hole. It is important to players of pinball machines how frequently a specific pattern is shown in the bonus winning display for a number of entries of balls into the advantage hole, in addition to whether the advantage hole allows easy entry of balls.

It is known from JP-A (Japanese Patent Laid-open Publication No.) 4-343874 to provide a display apparatus externally attached for cooperation with each of such pinball machines. This display apparatus is constructed to indicate such information as the number of occurrences of a big win, and the number of entries of balls into the advantage hole, both summed since the opening time of the gaming hall each day. The display apparatus has a call push button, which the player can depress to call for help from the gaming hall staff, when a game as played is involved with an accident or error in operation of the pinball machine.

A slot machine has a set of symbol-displaying reels, or a CRT showing images of such rotary reels. At the start of a game, the reels or the like are rotated and then stopped according to probability. A stopped combination of symbols appears along a winning line across the front of the reels. If the symbol combination as stopped coincides with a specific winning combination, the player is given one of the various wins preset in the slot machine. Those wins are ranked differently as to prizes and advantages to be given to the player. There is a big win, which can be given when a combination "7—7—7" appears. Upon the occurrence of a big win, big bonus games different from a normal game are played next. In a big bonus game, the probability of winning a prize is set to be higher than in a normal game. The player can enjoy this advantage by increasing the number of tokens he inserts.

A single gaming hall may contain both pinball machines and slot machines. It is important to players of slot machines how frequently winning games occur, and in addition how many big wins have occurred. However, the known display apparatus for pinball machines cannot be adapted to the above-described slot machines, because the generally available slot machines are all different from the pinball machines as to kinds of wins, advantages and prizes given to players.

It is inconvenient to design a display apparatus solely adapted for slot machines. There are frequently occasions when the gaming hall rearranges or exchanges gaming machines. If the display apparatuses are differently designed for the different gaming machines, the gaming hall staff is obliged to rearrange or exchange such display apparatuses so as to associate them only with corresponding gaming machines.

Although the above known display apparatus for a pinball machine displays a big win number and an advantage-hole entry number, it is still unknown to provide a structure for displaying how many balls or tokens have been paid or rewarded to a player. The player lacks precise knowledge as to his reward, so that the known display apparatus fails to give him information that will heighten his interest in playing games.

OBJECTS OF THE INVENTION

In view of the foregoing problems, an object of the present invention is to provide a display apparatus for a gaming machine, which is conveniently adaptable to two or more different kinds of gaming machines.

Another object of the present invention is to provide a display apparatus for a gaming machine, which is capable of giving a player information that will heighten his interest in playing games.

SUMMARY OF THE INVENTION

In order to achieve the above and other objects and advantages of this invention, a display apparatus is used with one gaming machine in which a play medium is bet to play a game. The display apparatus is adapted to the external display of information regarding conditions of the gaming machine. The gaming machine pays play media when the game results in a win. The win comprises a normal win and at least one kind of specific win for which more play media are paid than for the normal win. The game comprises a normal game and at least one kind of bonus game of which the probability of winning is set higher than in the normal game. The bonus game is triggered when the specific win is acquired. The gaming machine generates a play signal representing the play of the game and a specific win signal representing the specific win. In the display apparatus, display means display the information. Memory means is provided with a display program stored therein and is accessed to drive the display means. Switch means is disposed in switchable fashion, is set in adaptation to the gaming machine, and signals switched information regarding the gaming machine. Control means is supplied with the play signal and the specific win signal, and executes the display program. The control means includes a first counter section for counting the times a normal game is played between the finish of playing a bonus game and the occurrence of a specific win, and a second counter section for counting the times the specific win occurs. The control means is supplied with the switched information from the switch means, and causes the display means responsively to display the number of times a normal game occurs and the number of times the specific win occurs.

The gaming machine further generates a bet signal representing betting of the playing medium, and a paying signal representing payment of the playing medium. The control means further includes a calculating section for calculating a net reward number of playing media rewarded by the gaming machine, in accordance with the bet signal and the paying signal. While playing a bonus game, the control means causes the display means to display the net reward number.

When the play of the bonus game is finished, the gaming machine inhibits further playing of any game. When one play of the bonus game is finished, the control means supplies the gaming machine with a release output, and releases the gaming machine from the mentioned inhibition, to permit the gaming machine to play a further game.

The present invention makes it possible to prepare the display program executed for driving the display apparatus in such a manner that at least part of the program is common to two or more kinds of gaming machine. It is therefore very easy to adapt the novel display apparatus to any one of a such different gaming machines. When the novel display apparatus is attached to a gaming machine, a player of the gaming machine can be given information that heightens his interest in playing games.

In a preferred embodiment, a win of the game further comprises a small specific win for which fewer playing media are paid than for the specific win. The gaming machine playing the normal game has a normal state and an advantage state. A normal game played in the advantage state has higher probability of a small specific win that when the game is played in the normal state. The display means further indicates the existence of an advantage state.

The display apparatus, after the triggering of the advantage state, has at least two advantage levels that differ in inhibition from indicating the triggering of the advantage state. The display means indicates the different advantage levels selectively.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
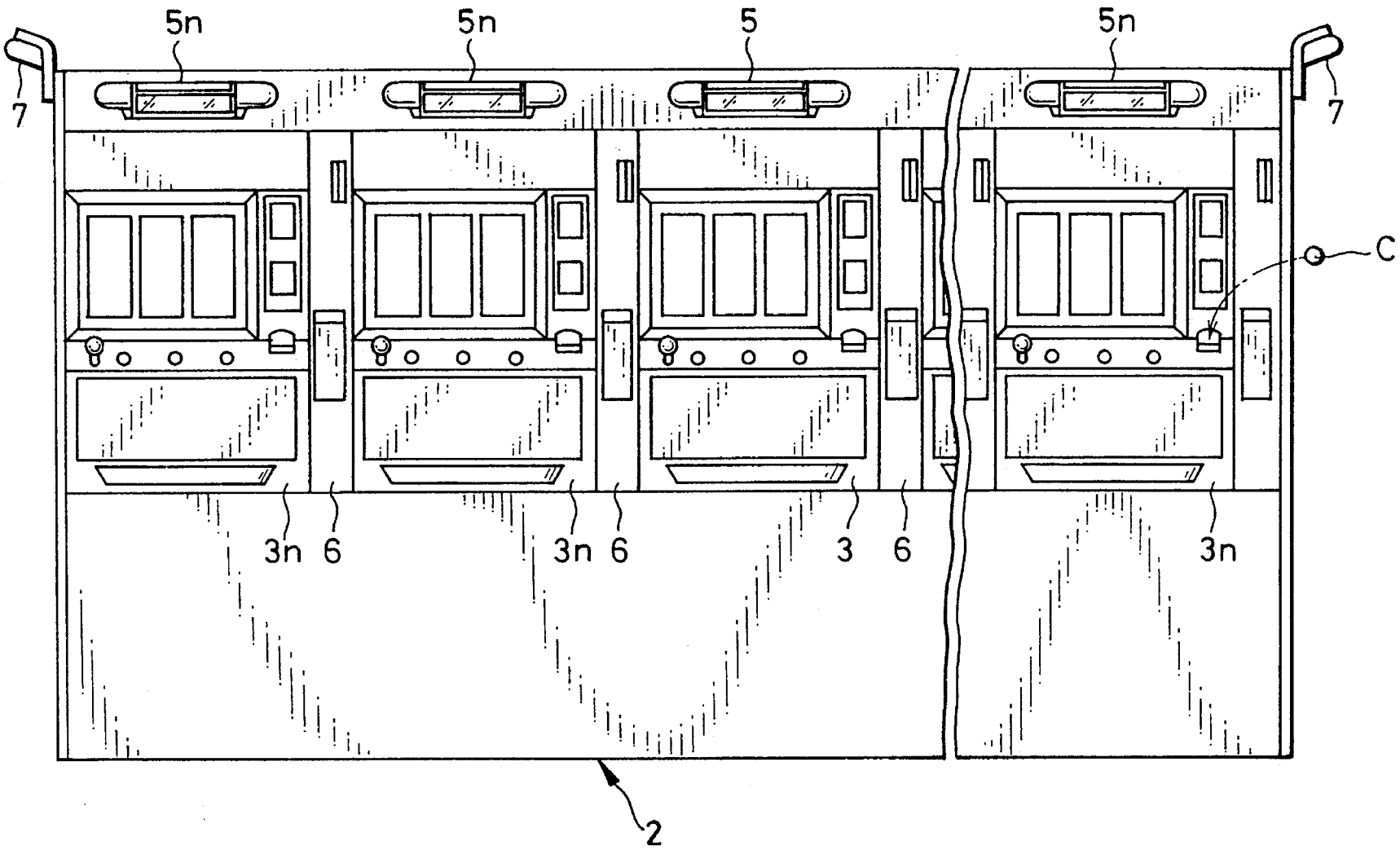
FIG. 1 is an explanatory view schematically illustrating a bank of slot machines and novel display apparatuses associated therewith.

In FIG. 1 is shown a bank of machines 2 in a gaming hall. The machine bank 2 is constituted of a plurality of slot machines 3 and 3*n*. An individual display apparatus 5 is associated with the slot machine 3, and connected thereto electrically. The display apparatus 5 displays various gaming conditions under which the associated slot machine 3 is operable. There are a plurality of other display apparatuses 5*n*, which are associated with the respective other slot machines 3*n*. In the machine bank 2, all the display apparatuses 5 and 5*n* are interconnected. Beside the slot machine 3 is installed a token dispenser 6 as an automatic vending machine of tokens C of a type valid as a playing medium to be bet in the slot machine 3. There are corner lamps 7 on each corner of the machine bank 2, actuable when a player wishes to call the staff of the gaming hall. The display apparatus has a call push button 16 illustrated in FIG. 2, which the player can depress to turn on the corner lamps 7, and can utilize them to call for help of the staff when a game as played suffers an accident or error in operation of the slot machine 3.

Figure 2:
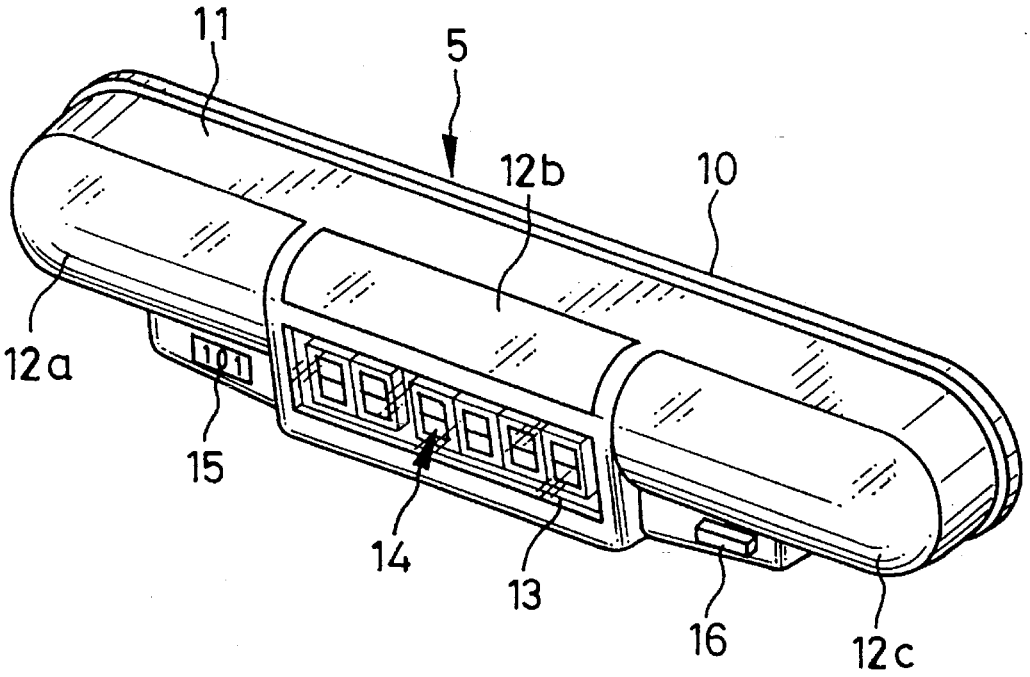
FIGS. 2 and 3 are respectively a perspective view and an exploded perspective view, both illustrating the display apparatus of FIG. 1.
Figures 3, 4:
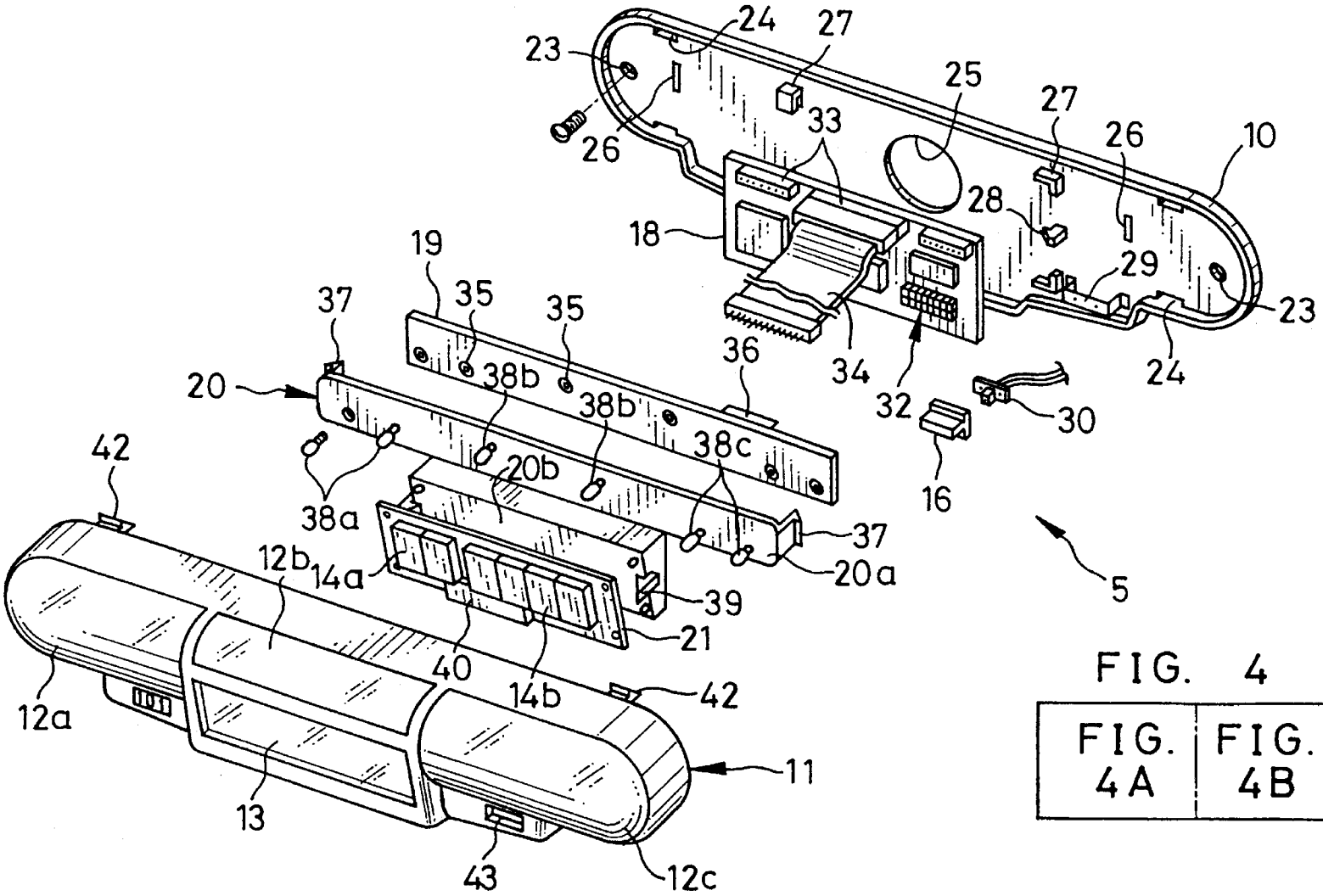

The display apparatus 5 is constructed as illustrated in FIGS. 2 and 3, and includes a rear support plate 10 and a front section 11 fitted thereunto. The front section 11 has a translucent cover 12*b* of red acrylic material and translucent covers 12*a* and 12*c* of yellow acrylic material. The inside of the covers 12*a* to 12*c* is respectively associated with an advantage level-indicating lamp 38*a*, 38*b*, 38*c* each constituted of two bulbs. The advantage level lamps 38*a* to 38*c* with the covers 12*a* to 12*c* constitute a status indicator device. When the advantage lamp 38*b* is turned on, red light is emitted from the red cover 12*b*. When the advantage level lamps 38*a* and 38*c* are turned on, yellow light is emitted from the yellow covers 12*a* and 12*c*. A transparent red plate 13 is fitted in the center of the front section 11. Behind the transparent plate 13 is disposed an LED device 14, which has six digits for indicating numerical information. A sticker or label 15 is attached to the front section 11, and bears a serial number given to the slot machine 3 in the gaming hall.

In FIG. 3, between the rear plate 10 and the front section 11, the display apparatus 5 includes a main board 18, a lamp base 19, a stay 20 and an LED support 21. The rear plate 10 is provided with screw holes 23 for receiving screws, slots 24 to receive hooks 42 on the front section 11, a cable hole 25 for insertion of a flexible cable 34, slots 26 to receive tongues 37 on the stay 20, and edge stoppers 27 and a hook 28 both for retaining the main board 18. The rear plate 10 is molded by injection molding as one piece. On the rear plate 10, a switch base 29 is mounted. A call switch 30 is fitted on the call push button 16, and mounted on the switch base 29.

The main board 18 has component circuits such as a power source section, a photo coupler device, a memory device, and a microcomputer 55 (FIG. 4A), and has a section of 16 DIP switches 32, which are separately switchable, so that it is possible to change the display condition of the display apparatus 5 to another one as desired. Connectors 33 are mounted on the main board 18. The flexible cable 34 is fitted on one of the connectors 33, and connects the display apparatus 5 to the slot machine 3 and the other external display apparatuses 5*n*.

The front of the lamp base 19 has contacts 35. The rear of the lamp base 19 has a connector 36 and a printed circuit for driving the advantage level lamps 38*a* to 38*c*. The lamp base 19 is fixedly secured behind the stay 20. The stay 20 is one piece molded from resin, and has lateral tongues 37, which are fitted in the slots 26 to fix the stay 20 on the rear plate 10. The stay 20 is generally constituted of an upper lamp holder 20*a* and a lower LED holder 20*b*, the former of which supports the advantage level lamps 38*a* to 38*c*.

The LED holder 20*b* holds the LED support 21 on which the LED device 14 is mounted. Four corners of the LED holder 20*b* are provided with respective pins, which are inserted and force fitted in, holes formed on corners of the LED Support 21. Two shorter sides of the LED holder 20*b* are provided with respective hooks 39, which retain sides of the LED support 21. The LED device 14 is constituted of 2-digit LEDs 14*a* and 4-digit LEDs 14*b*, between which there is a space for distinguishing the 2-digit value from the 4-digit value. The LED support 21 is connected via a connector 40 to the main board 18.

The front section 11 has hooks 42, which, as previously indicated, are engaged in, and thus secured by, the slots 24 in the rear plate 10. The front section 11 has an opening 43, through which the call push button 16 for a call protrudes.

Figure 4A:
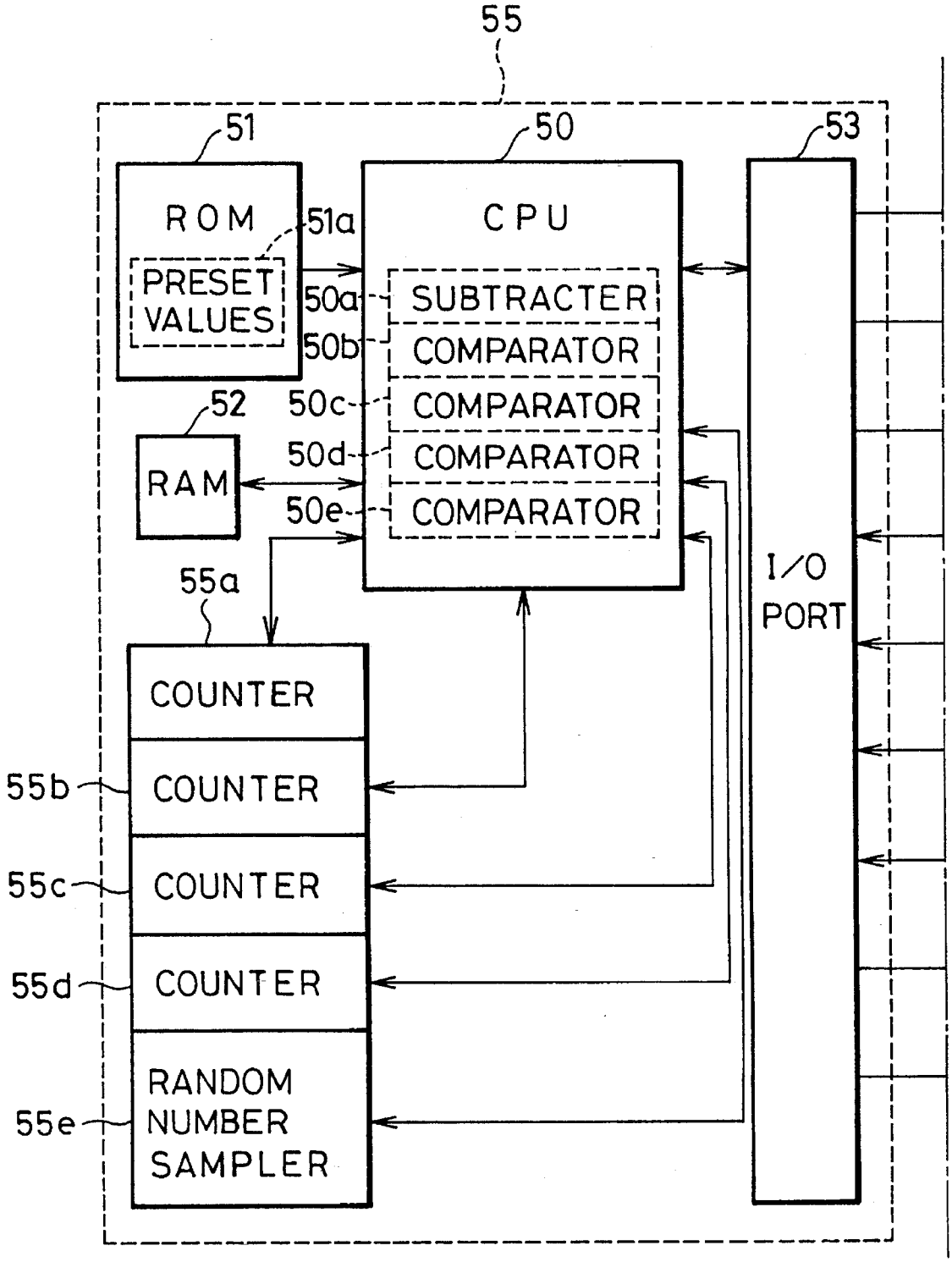
FIGS. 4A and 4B are block diagrams illustrating relevant circuits constituting the display apparatus, FIG. 4 illustrating the relationship of FIGS. 4A and 4B to each other.
Figure 4B:
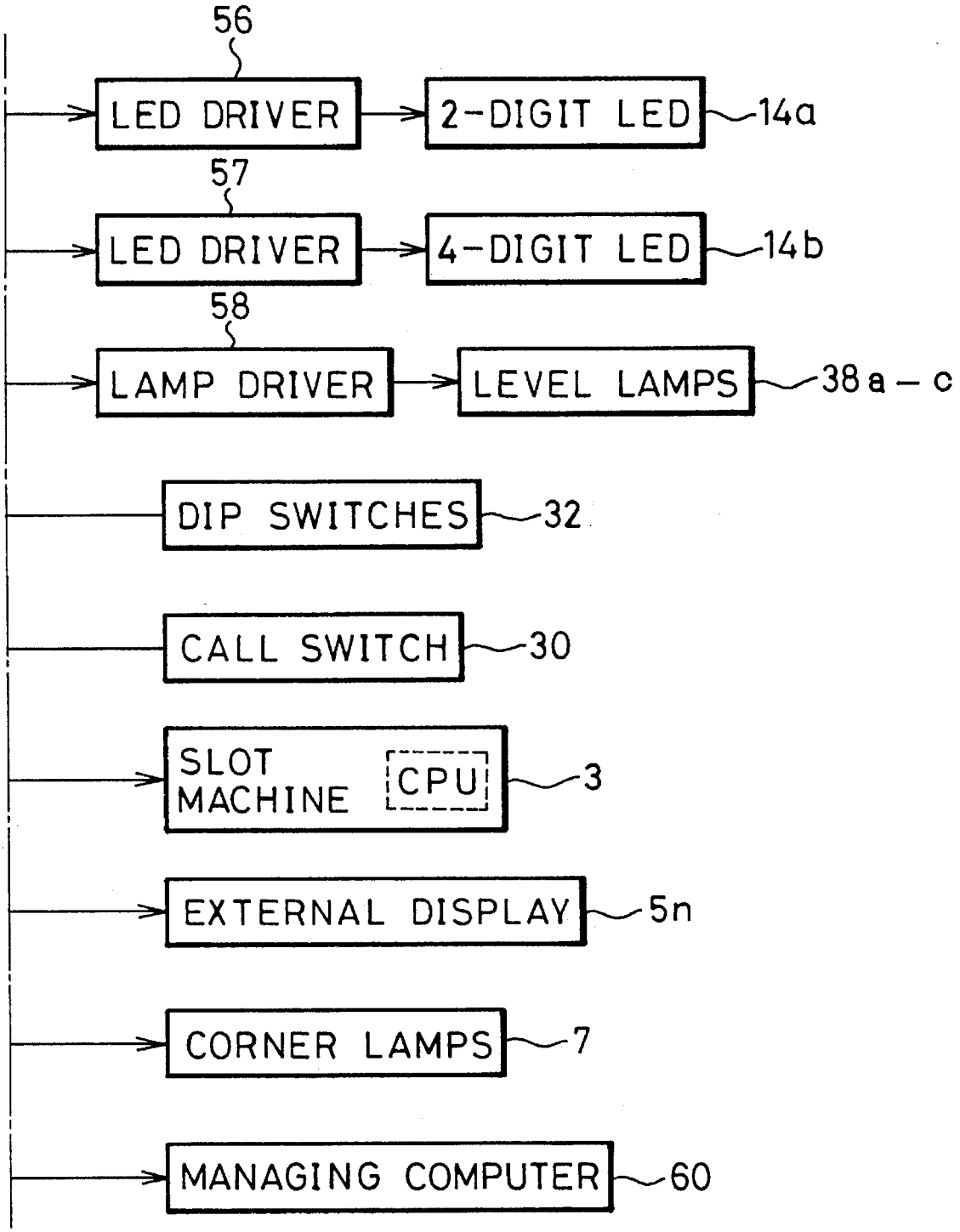

FIGS. 4A and 4B illustrate circuitry of the display apparatus 5. The microcomputer 55 is mounted on the main board 18, and includes a CPU 50, a ROM 51, a RAM 52 and an I/O port 53. ROM 51 stores a program for operation of the display and has a preset value storage 51*a*, which stores various data tables and preset values, to be used in execution of the display program. CPU 50 executes the display program in response to information which is inputted by the slot machine 3 and represents various gaming conditions. In execution of the display program, CPU 50 also refers to information of a setting of the DIP switches 32. CPU 50 sends signals to LED drivers 56 and 57 and a lamp driver 58, the first of which drives the 2-digit LEDs 14*a*, the second of which drives the 4-digit LEDs 14*b*, and the last of which drives the advantage level lamps 28*a* to 38*c*. RAM 52 temporarily stores the information from the slot machine 3 and the data to be processed during the display program. The information and the data are referred to opportunely by the CPU 50 in the course of operation of the display apparatus 5.

The microcomputer 55 is supplied with a signal generated by operation of the call switch 30, the information from the slot machine 3, and information generated from the other display apparatuses 5*n* in the same machine bank 2. In turn, the microcomputer 55 supplies the slot machine 3 and the other display apparatuses 5*n* with an external display output for a big win, as is described later in detail. When the call switch 30 is operated, the microcomputer 55 supplies the corner lamps 7 with an actuating signal for turning them on. The information from the slot machine 3 associated with the display apparatus 5 is also sent to a managing computer 60, which is used for general management of all the gaming machines installed in the gaming hall.

Reference is now made to adjustment of the display apparatus 5 when in use with the slot machine 3. Wins acquirable in playing a game with the slot machine 3 are of a plurality of kinds:

Normal win is given to a symbol combination of the same symbols, such as "PLUM", which appear along a winning line, among a number of symbols formed about each of three reels of the slot machine 3. A normal win is also given when one or two "CHERRY"s are stopped on the winning line.

Big win is given to a symbol combination "7—7—7". A number of games which follow the big win are "big bonus games".

Medium win is given to a symbol combination "BAR—BAR—BAR". A number of games which follow the medium win are simple bonus games.

Small win is given to a symbol combination "MELON—MELON—MELON". Only one simple bonus game follows the small win.

A player playing the slot machine 3 is given advantages under the following conditions:

Big bonus games following a big win: The player is allowed to play 30 big bonus games, in each of which the probability of a small win is higher than in a normal game. In a game succeeding each small win, a bonus prize of 15 tokens is paid to the player.

Simple bonus games following a medium win: The player is allowed to play 12 bonus games, and can insert tokens C as many as the number of reels with which he wants to play a bonus game. When at least one symbol of "JACK" on each reel is stopped on a winning line, the player is given a bonus prize. 15 tokens are paid to the player. Such bonus prizes are limited to at most six after a medium win. As soon as six bonus prizes occur after a medium win, the player is returned to playing normal games, even before the end of 12 bonus games.

Simple bonus game following a small win: When a symbol of "Jack" is stopped, the player is given a bonus prize, which is 15 tokens.

Advantage state: The slot machine 3 operates to enter the advantage state. During the advantage state, the probability of a "small win" during a game is higher than in a normal state, which in turn is different from the advantage state. When a normal win with a stopped symbol "PLUM" is acquired during the advantage state, a game following the normal win is played to give 15 tokens, a bonus prize corresponding to a small win under the control of the slot machine 3. The entry into the advantage state is determined in the slot machine 3 in accordance with probability, and has no relation to any particular symbol combination like "7—7—7" stopped along a winning line. The exit from the advantage state to the normal state is determined according to probability.

Bonus games and the advantage state are executed under the following additional conditions which correlate them:

Bonus games: Upon the occurrence of a medium win by playing a bonus game, a second series of bonus games is awarded to the player. Also, as soon as a symbol combination of three "JACK"s stops along a winning line, a second series of bonus games is playable. The second series of bonus games is an interruption of the first series of bonus games. When the second series is finished, the remainder of the first series is resumed if the first series is not yet finished.

Advantage state: During the advantage state, a big win or a medium win may occur. Upon the occurrence of a big win or a medium win, the advantage state is terminated and the machine returns to the normal state.

The slot machine 3 incorporates a CPU or microcomputer 3*a*, and controls the above wins and associated various conditions. The slot machine 3 is so constructed that, when each game is started, the slot machine 3 responsively outputs a play signal. The slot machine 3 also generates an inserted token number signal representing the number of tokens C inserted at the start of a game, a big win signal representing the occurrence of a big win, a medium win signal representing the occurrence of a medium win, a small win signal representing the occurrence of a small win, and a paid token number signal representing the number of tokens C paid out to the player. All these signals are sent to the microcomputer 55 in the display apparatus 5.

In response to the various signals from the slot machine 3, the display apparatus 5 operates to display various information. The display apparatus 5 is also adapted to send a signal to the slot machine 3 when the slot machine 3 is stopped upon reaching a payable limit of tokens C, as described later in detail. The display apparatus 5 is adaptable to slot machines other than that described, and also to other gaming machines such as pinball machines. The DIP switches S1 to S16 are changed upon the occurrence of various conditions as described below:

S1 on: to display the number of played normal games with the 4-digit LEDs 14*b*, occasionally with a lower priority than the DIP switch S6 (See Table 3);

S1 off: not to display the same.

Note that the normal game number represents normal games which are different from big bonus games, and played after the finish of a series of big bonus games. Such games as counted are played in the normal state and the advantage state, and include ones following a medium win.

S2 on: to display the number of acquired big wins with the 2-digit LEDs 14*a;*

S2 off: not to display the same.

S3 on: to display the net number of acquired tokens C as reward with the 4-digit LEDs 14*b*, during big bonus games after a big win, by subtraction of the inserted token number from the paid token number;

S3 off: not to display the same.

S4 on: to display the net number of acquired tokens C as reward with the 4-digit LEDs 14*b*, during games after a medium win or during games after triggering of the advantage state;

S4 off: not to display the same.

S5 on: to display triggering into the advantage state but irrespective of different Advantage Levels;

S5 off: to display different Advantage Levels by use of the lamps 38*a* to 38*c*.

S6 on: to actuate the 4-digit LEDs 14*b* according to the setting of the DIP switch S1, without displaying the number of acquired small wins;

S6 off: to display the number of acquired small wins with the 4-digit LEDs 14*b*, during Mode B of the Advantage Levels (See Table 3).

S7 on: to terminate the indication of the Advantage Levels at the end of successively played big bonus games, after a big win has occurred after the triggering of the advantage state;

S7 off: to terminate the indication of the Advantage Levels at the end of successively played bonus games, after either a big win or a medium win has occurred after the triggering of the advantage state.

S8 on: to use the other display apparatuses 5*n* to display the occurrence of a big win;

S8 off: not to use the same.

S9 on: to allow sending a release output for releasing the stopping of the gaming machine, irrespective of the DIP switches S10 to S14;

S9 off: to condition the sending of a release output for releasing the stopping of the gaming machine, according to settings of the DIP switches S10 to S14.

S10 on: to utilize the sampling of a random number and the settings of the DIP switches S11 to S14, to determine the sending of a release output;

S10 off: to utilize a payable limit number set by use of the DIP switches S11 to S14, to determine the sending of a release output.

S15 on: to blink the 4-digit LEDs 14*b* for 5 minutes at the end of big bonus games following a big win, and subsequently to keep the 4-digit LEDs 14*b* turned on continuously.

S15 off: to blink the 4-digit LEDs 14*b* for 30 seconds at the end of big bonus games following a big win, and subsequently to turn off the 4-digit LEDs 14*b*.

S16 on: to change over to a slot machine, in accordance with the program stored in ROM 51;

S16 off: to change over to a pinball machine, in accordance with the program stored in ROM 51.

If the DIP switch S10 is turned on, then the DIP switches S11 to S14 operate as follows:

S11 on: to select Probability Table 1 in the preset value storage 51*a* in ROM 51, for sampling a random number;

S11 off: to select Probability Table 2 in the preset value storage 51*a* in ROM 51, for sampling a random number.

S12 on: to set a number "7777", and to allow sending the release output only when the sampled random number coincides with "7777";

S12 off: not to send any release output.

S13 on: to set a number "5555", and to allow sending the release output only when the sampled random number coincides with "5555";

S13 off: not to send any release output.

S14 on: to set a number "3333", and to allow sending the release output only when the sampled random number coincides with "3333";

S14 off: not to send any release output.

If the DIP switch S10 is turned off, then the DIP switches S11 to S14 operate to determine the payable limit, which is compared with the paid token number, and which allows sending the release output only if the paid token number is less than the payable limit. The payable limit is determined as follows:

TABLE 1

| S11 | S12 | S13 | S14 | Limit |
|---|---|---|---|---|
| On | On | On | On | 2000 |
| On | On | On | Off | 2000 |
| On | On | Off | On | 2000 |
| On | On | Off | Off | 2000 |
| On | Off | On | On | 2000 |
| On | Off | On | Off | 2000 |
| On | Off | Off | On | 2000 |
| On | Off | Off | Off | 2000 |
| Off | On | On | On | 1500 |
| Off | On | On | Off | 1500 |
| Off | On | Off | On | 1500 |
| Off | On | Off | Off | 1500 |
| Off | Off | On | On | 1000 |
| Off | Off | On | Off | 1000 |
| Off | Off | Off | On | 500 |

TABLE 1-continued

| S11 | S12 | S13 | S14 | Limit |
|---|---|---|---|---|
| Off | Off | Off | Off | 5000 |

Indication of the Advantage Levels after entry into the advantage state will now be described. In the advantage state, normal games are played as in the normal state, but with an increased probability of acquiring small wins. CPU 50 has a normal game counter 55*b* which counts the number of played normal games, and a small win counter 55*d* which counts the number of acquired small wins. The play signal in use herein is an inserted token signal generated upon insertion of a token C into the slot machine 3. Note that a play signal may alternatively consist of a signal generated upon the swinging of a start lever on the slot machine 3 for starting the reels of the slot machine 3.

It is possible to insert two or three tokens C for playing only one game. To use the inserted token signal as a play signal, the microcomputer 55 has a timer (See FIG. 7) which makes it possible without fail to determine that only a single game is to be played, even though plural tokens have been inserted. To this end, the first of the plural tokens triggers the actuation of the timer, which starts to measure time of a preset duration. A single play signal can be obtained while the timer measures the time.

The microcomputer 55 processes a count signal generated by the normal game counter 55*b* and a small win signal generated by the slot machine 3, and determines one of the Advantage Levels to be externally displayed after triggering of the advantage state. Such a determined Advantage Level is displayed by selective actuation of the level lamps 38*a* to 38*c*, at the same time that the microcomputer 55 causes the 4-digit LEDs 14*b* to indicate the normal game number and the small win number.

The slot machine 3 has an advantage state and a normal state. In association with these, the display apparatus 5 has a Normal Level and Advantage Levels. The slot machine 3 does not trigger the advantage state without causing the display apparatus 5 to indicate the Advantage Levels. However, the display apparatus 5 returns to indication of the Normal Level irrespective of the return of the slot machine 3 to the normal state. The indication of the Normal Level and the seven Advantage Levels by use of the display apparatus 5 is changed in the following manner:

During indication of the Normal Level: If a small win occurs, then the indication is changed to Advantage Level 1.

During indication of Advantage Level 1: If a small win occurs while playing at most ten games, then the indication is changed to Advantage Level 2. If ten games are played without any small win, then the indication is changed to the Normal Level.

During indication of Advantage Level 2: If a small win occurs while playing at most eight games, then the indication is changed to Advantage Level 3. If eight games are played without any small win, then the indication is changed to Advantage Level 1.

During indication of Advantage Level 3: If a small win occurs while playing at most eight games, then the indication is changed to Advantage Level 4. If eight games are played without any small win, then the indication is changed to Advantage Level 2.

During indication of Advantage Level 4: If a small win occurs while playing at most 15 games, then the indication is maintained at Advantage Level 4. If 15 games are played without any small win, then the indication is changed to Advantage Level 5.

During indication of Advantage Level 5: If a small win occurs while playing at most five games, then the indication is changed to Advantage Level 4. If five games are played without any small win, then the indication is changed to Advantage Level 6.

During indication of Advantage Level 6: If a small win occurs while playing at most five games, then the indication is changed to Advantage Level 5. If five games are played without any small win, then the indication is changed to Advantage Level 7.

During indication of Advantage Level 7: If a small win occurs while playing at most five games, then the indication is changed to Advantage Level 6. If five games are played without any small win, then the indication is changed to the Normal Level.

The signals associated with the Normal Level and the seven Advantage Levels are given in the following Table 2:

TABLE 2

| | Signals | |
|---|---|---|
| | Light Patterns of Lamps 38a–c | Modes of LEDs 14b |
| Normal Level Advantage Levels | P0 | A |
| 1 | P1 | A |
| 2 | P2 | A |
| 3 | P3 | A |
| 4 | P4 | B |
| 5 | P5 | B |
| 6 | P6 | B |
| 7 | P7 | B |

Note that in Table 2 the light patterns are shown by selective actuation of the advantage level lamps 38*a* to 38*c* and selective illumination through the yellow covers 12*a* and 12*c* and the red cover 12*b*, as follows:

Light Pattern P0: All the lamps 38*a* to 38*c* are turned off. There is no illumination of the covers 12*a* to 12*c*.

Light Pattern P1: Only the lamp 38*a* is turned on and blinks. Only the yellow cover 12*a* shines and blinks.

Light Pattern P2: Only the lamp 38*b* is turned on and blinks. Only the red cover 12*b* shines and blinks.

Light Pattern P3: Only the lamp 38*c* is turned on and blinks. Only the yellow cover 12*c* shines and blinks.

Light Pattern P4: All the lamps 38*a* to 38*c* are turned on and blink. All the yellow and red covers 12*a* to 12*c* shine and blink.

The 4-digit LEDs 14*b* operate differently from Modes A and B. Operation of the 4-digit LEDs 14*b* also depends on the settings of S1 and S6, and as follows (following the flow diagram of FIG. 16 later to be described).

TABLE 3

| S1 | S6 | Mode A | Mode B |
|---|---|---|---|
| On | On | Normal game number | Normal game number |
| On | Off | Normal game number | Small win number |
| Off | On | No indication | No indication |
| Off | Off | No indication | Small win number |

Note that when the DIP switch S5 is turned on, the advantage level lamps 38*a* to 38*c* do not indicate a different Advantage Level. While the DIP switch S4 is turned on, the occurrence of a small win causes the 4-digit LEDs 14*b* to indicate the net reward number of tokens C before displaying a normal game number and/or a small win number. Note that the 4-digit LEDs 14*b* are driven to show various patterns illustrated in FIGS. 5A to 5H. Those patterns are all stored in ROM 51, and selected by CPU 50 in response to the signals from the slot machine 3. CPU 50 sends drive signals to the LED driver 57 for display.

Figure 5A:
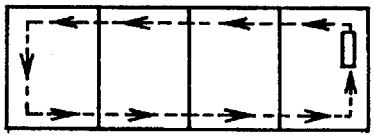
FIGS. 5A to 5H are explanatory views illustrating various patterns shown by 4-digit LEDs of the display apparatus.

The first pattern in FIG. 5A occurs upon actuation of single LED segments; that is, there is only one LED segment turned on at one time. The single LED segments are driven one after another in sequential fashion as if the illumination were moved along the 4-digit LEDs 14*b*. This pattern in FIG. 5A is displayed when the DIP switch S4 is turned off. The pattern in FIG. 5A is shown displayed when the DIP switch S4 is turned on but before the net reward number appearing on the 4-digit LEDs 14*b* increases to a preset limit number.

Figure 5B:
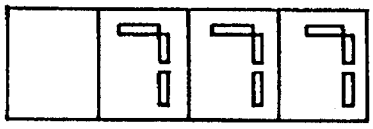
Figure 5C:
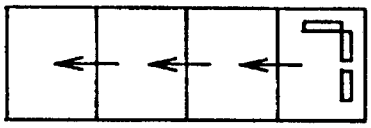

The second pattern "777" in FIG. 5B is used for demonstrating the occurrence of a big win, and blinks until the number of played games reaches a preset limit number, or until any first payment of a bonus prize. In the third pattern in FIG. 5C, there is only one digit showing "7" at one time. The single digits are driven from the right to the left in sequential and repeated fashion as if the numeral "7" moved horizontally. This pattern is used when the DIP switch S3 is turned off, and also after beginning payment of a bonus prize in big bonus games.

Figure 5D:
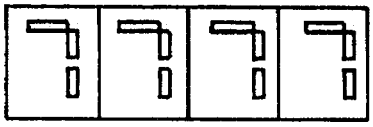
Figure 5E:
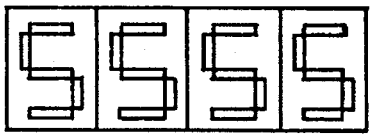
Figure 5F:
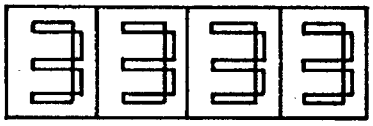

FIGS. 5D to 5F have the respective patterns associated with the operation of random number sampling. When the DIP switch S9 is turned off and when the DIP switch S10 is turned on, then a random number is sampled in response to the end of big bonus games following a big win, for the purpose of determining whether the slot machine 3 is permitted to play further games. Such a random number is sampled by the random number sampler 55*e*. One of Probability Tables 1 and 2 is referred to, so as to determined a random number, which is displayed on the 4-digit LEDs 14*b*. The sampled number is checked for coincidence with a particular 4-digit value set by the DIP switch S12, S13 or S14. In the case of coincidence, the microcomputer 55 sends a release output to the slot machine 3, and releases the slot machine 3 from the inhibition of further gaming. Note that Probability Tables 1 and 2 are differently prepared such that the probability of coinciding with each of "3333", "5555" and "7777" is set to be different between them, which of course can be selected by changing over the DIP switch S11.

Figure 5G:
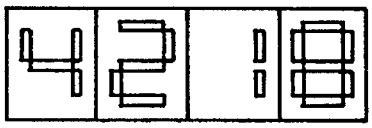
Figure 5H:
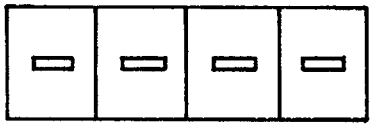

The seventh pattern in FIG. 5G is a given numerical value, and is used for representing a number sampled by the random determination above but without coincidence with "3333" or the like, or representing the net reward number during a game either after the triggering of the advantage state or following a big win or a medium win. The eighth pattern in FIG. 5H is a long dash without a number and is used when the sampled random number does not coincide with "3333" or the like, and may be used for representing inhibition of continuing the play of games while the DIP switches S12 to S14 are turned off.

Figure 6:
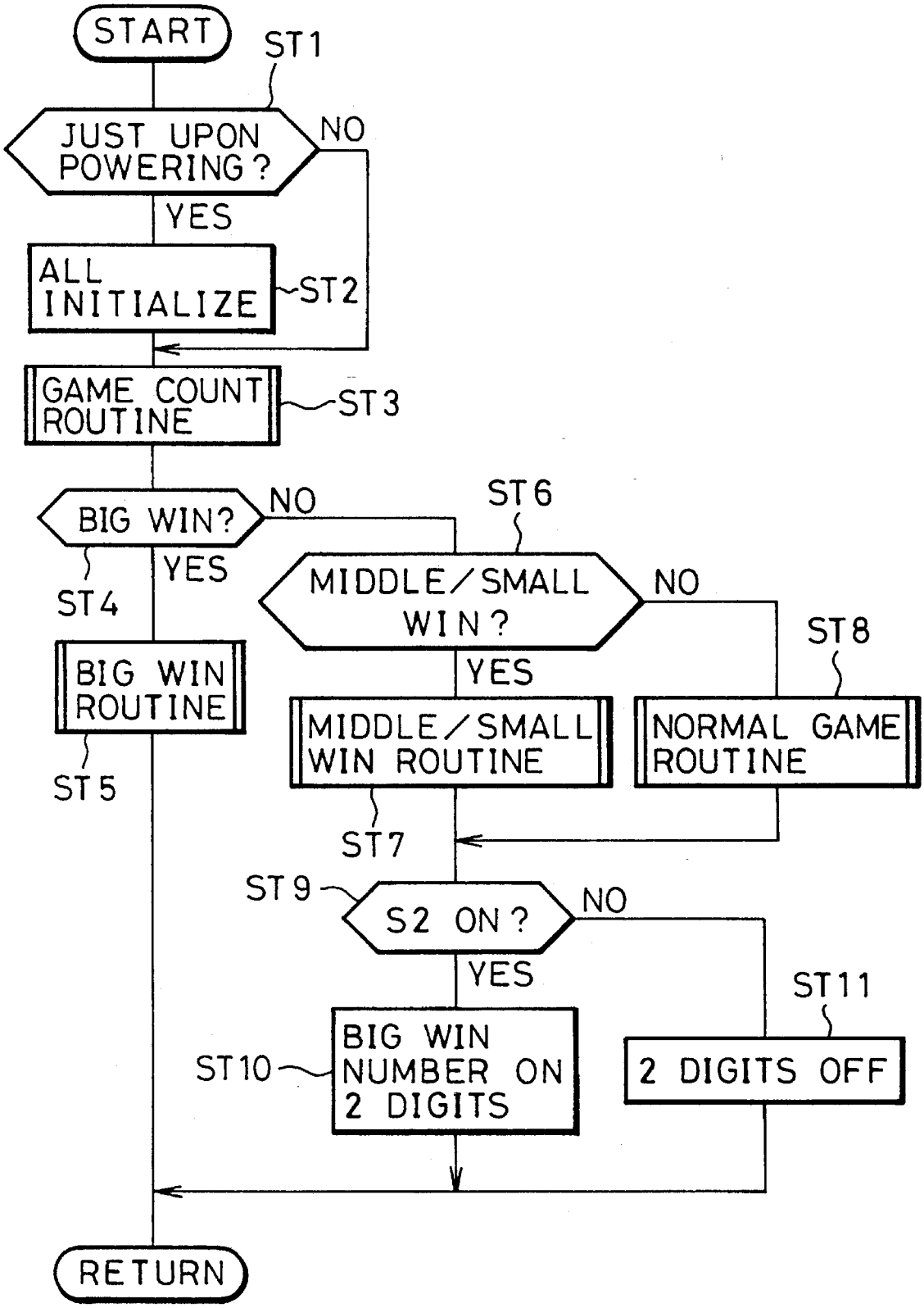
FIG. 6 is a flow chart illustrating a main routine of the display apparatus as adapted to a slot machine.

The operation of the display apparatus 5 with the slot machine 3 will now be described with reference to the flow charts beginning with FIG. 6. FIG. 6 is the main routine of operating the microcomputer 5. In a step ST1, CPU 50 checks whether the display apparatus 5 has been powered, or turned on, only for a sufficiently short time. This occurs generally at the opening time of a gaming hall containing the slot machines 3. If the display apparatus 5 is judged to have been powered initially, then all components of the microcomputer 55 are initialized in a step ST2, in which various flags and data stored in RAM 52 so far are cleared or reset. To repeat the main routine of FIG. 6, the microcomputer 55 is supplied by the slot machine 3 with an inserted token signal, in response to which the microcomputer 55 enters a game count routine in a step ST3 (See FIGS. 7 and 8). The game count routine writes the number of played games into an address area provided in RAM 52.

To repeat playing a game, CPU 50 in a step ST4 checks whether a big win has occurred. If a big win is judged to have occurred, then the microcomputer 5 enters a big win routine in a step ST5 (See FIGS. 9 to 13). If no occurrence of a big win is judged, then CPU 50 in a step ST6 checks whether a medium win or a small win has occurred. If a medium win or a small win is judged to have occurred, then the microcomputer 5 enters a medium/small win routine in a step ST7 (See FIGS. 14 and 15). If no occurrence of a medium win or a small win is judged, then the microcomputer 5 enters a normal game routine in a step ST8. After the steps ST7 and ST8, CPU 50 in a step ST9 checks whether the DIP switch S2 is turned on. If the DIP switch S2 is turned on, then the number of big wins as acquired is displayed on the 2-digit LEDs 14*a* in a step ST10. If the DIP switch S2 is turned off, the 2-digit LEDs 14*a* remain turned off.

Figure 7:
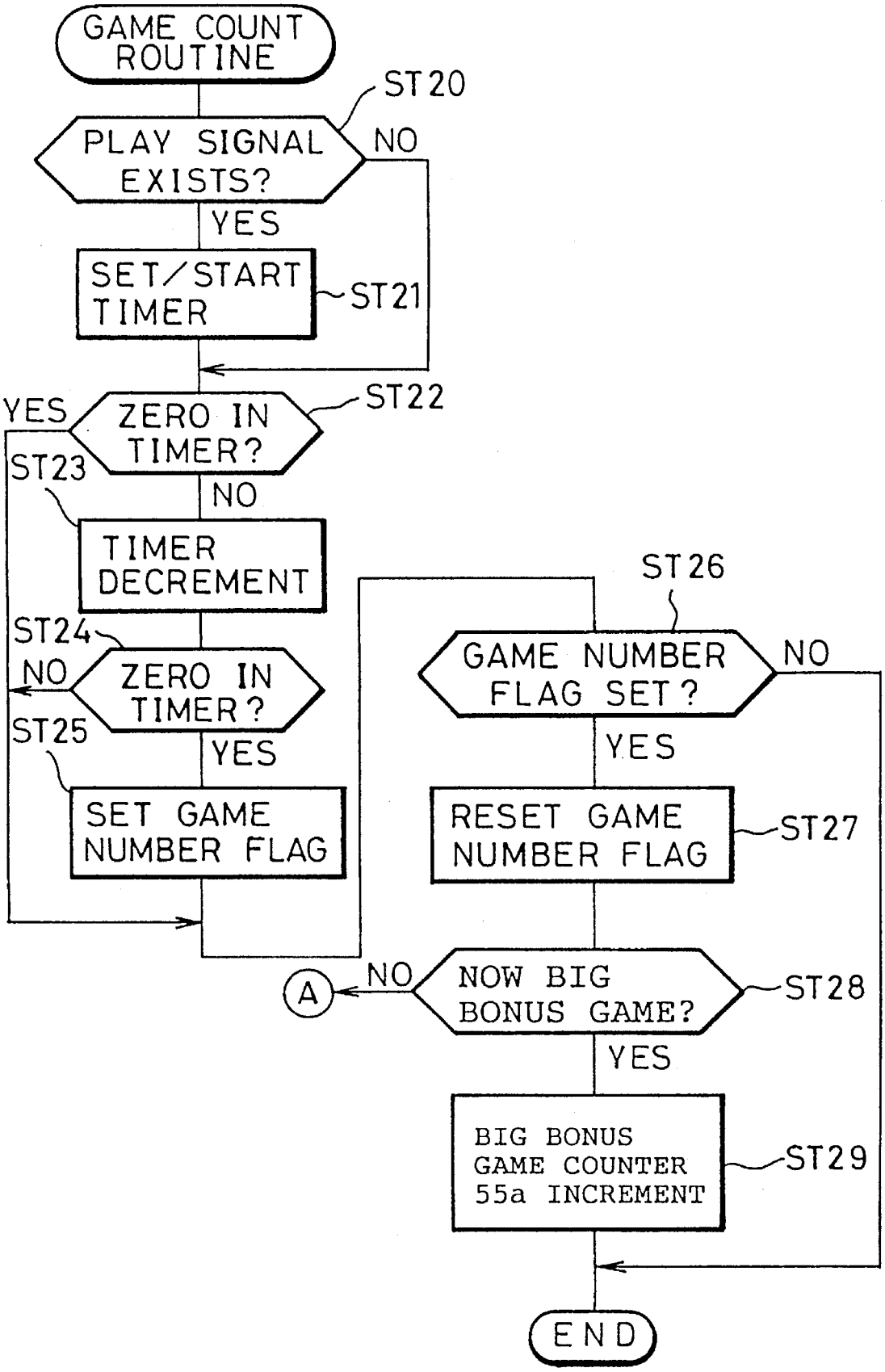
FIGS. 7 and 8 are flow charts illustrating a subroutine of counting games.

FIG. 7 illustrates the game count routine referred to in step ST3 in FIG. 6. Games played with the slot machine 3 are counted by counting the inserted token signals as described above. The slot machine 3 usually generates inserted token signals having different forms between continuously inserted plural tokens and a single token C. Should the microcomputer 55 monitor inserted token signals by scanning operation over too short an interval, it would be possible for the display apparatus 5 to count two or three games when in fact a player desires to play out a single game while betting two or three tokens C. The microcomputer 55 is constructed to count inserted token signals not token by token but game by game, for performing a single count corresponding to one or more tokens C successively inserted. This is possible by use of a game number counting timer as illustrated in FIG. 7.

In a step ST20, the existence of a play signal supplied by the slot machine 3 is checked. In a step ST21, the game number counting timer is set to a predetermined time and starts measuring time. In steps ST22 to ST24, the timer decrementally measures time. When the measurement on the timer decreases to "zero", the time is up. A step ST25 sets the game number flag as "1". After a step ST26, a step ST27 resets the game number flag as "zero". CPU 50 in a step ST28 then checks whether a big bonus game is played as a process entered after a big win. If in the step ST22 the timer counts "zero", then the game number flag in step ST26 remains reset, without being set, so as to end the game count routine.

If in step ST28 a big bonus game is judged to be played, then a step ST29 causes a big bonus game counter 55*a* to count the big bonus game incrementally. If step ST28 judges no big bonus game to be played, then a step ST30 in FIG. 8 causes the normal game counter 55*b* to count a normal game incrementally. The normal game counter 55*b* is thus adapted to count normal games as played, that is, games different from big bonus games and such games as have occurred before each big win and after each series of big bonus games. A normal game is counted also after the triggering of the advantage state and after a medium win.

After the counter increment in step ST30, CPU 50 in a step ST31 checks whether a game-counting level counter counts "zero". The level counter is used for counting games played after the triggering of the advantage state or after a medium win, for the purpose of triggering a change of the sequence among seven Advantage Levels from one to another. If the level counter counts "zero" in step ST31, then the game count routine is ended because the display now is different from the Advantage Levels and because the game is not what would follow a medium win. If the level counter counts differently from "zero" in the step ST31, the slot machine 3 is judged to be in a condition after entry into the advantage state or after a medium win. A step ST32 then causes the level counter to count a game decrementally. CPU 50 in a step ST33, for a second time, checks whether the level counter counts "zero".

If step ST33 judges that the level counter counts differently from "zero", then the game count routine is ended. If the level counter is judged to count "zero", then a step ST34 changes the present Advantage Level to be one succeeding level designated by the aforementioned sequence of changes between the Advantage Levels. The microcomputer 55 then enters a step ST35 of a level counter setting routine (See FIG. 17). In a step ST36, the DIP switch S5 is checked to be either on or off. If the DIP switch S5 is off, then the microcomputer 55 in a step ST37 enters a level lamp actuating routine (See FIG. 18). If the DIP switch S5 is on, then the game count routine is ended, without entry into the advantage level lamp actuating routine.

Figure 9:
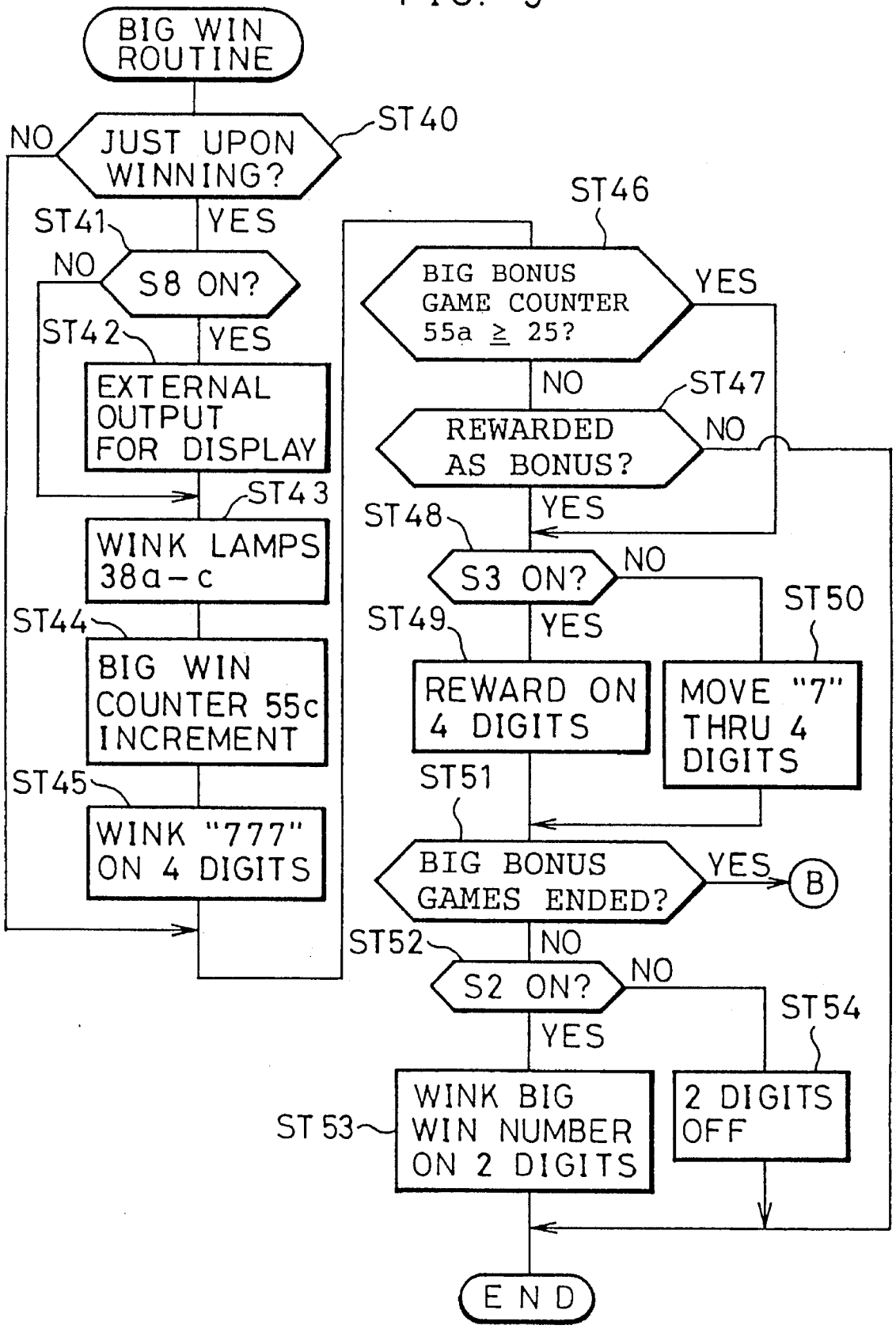
FIGS. 9 and 10 are flow charts illustrating a subroutine initiated upon a big win.

The flow chart of FIG. 9 illustrates the big win routine entered upon a big win. CPU 50 in a step ST40 checks what is now counted by the big bonus game counter 55*a*, and checks whether such a big win has been acquired only for a sufficiently short time. If it has not, then the microcomputer 55 enters a step ST46. But if a big win has been acquired, then CPU 50 in a step ST41 checks whether the DIP switch S8 is on. If the DIP switch S8 is on, then the microcomputer 55 in a step ST42 generates an external display output for a big win. If the DIP switch S8 is off, then no external display output occurs.

The external display output is generated by the display apparatus 5 upon the occurrence of a big win, and is sent to other display apparatuses 5*n* installed in the same machine bank 2, and causes additional actuation of the plural apparatuses. Namely the occurrence of a big win even in a single slot machine 3 causes collective actuation of the display apparatuses 5 and 5*n* included in the machine bank 2. For such a big win, all the level lamps 38*a* and 38*c* of the display apparatuses 5 and 5*n* are used. Note that it is preferable to determine an additional sequence of driving the display apparatuses 5 and 5*n* so as to turn on/off the sets of lamps 38*a* to 38*c* as if their illumination were converging from the other display apparatuses 5 toward the display apparatus 5 relevant to the big win.

Even if the DIP switch S8 is off, then a step ST43 causes the advantage level lamps 38*a* to 38*c* together to blink for the purpose of actuation of the unique display apparatus 5. A next step ST44 causes a big win counter 55*c* to count the big win incrementally. A step ST45 causes the 4-digit LEDs 14*b* to blink to show the pattern "777" in FIG. 5B, which displays the big win that has occurred in the slot machine 3.

In a step ST46 a big bonus game number comparator 50*b* operates with the preset value storage 51*a*, and checks whether the big bonus game counter 55*a* counts a value equal to or more than 25, as a result of incremental counting of big bonus games in step ST29 in FIG. 7. If the count value is less than 25, then CPU 50 in a step ST47 checks whether any bonus prize has been paid after the start of big bonus games. The process of steps ST46 and ST47 has the purpose of avoiding the display of a net reward number when it is less than "zero" in a step ST49.

A step ST48 follows, and checks whether the DIP switch S3 is on. If it is, then step ST49 displays the net reward number on the 4-digit LEDs 14*b*. If the DIP switch S3 is off, then a step ST50 displays the digit "7" moving along the 4-digit LEDs 14*b* as in FIG. 5C. CPU 50 in a step ST51 checks whether a preset number of big bonus games to follow the big win have been finished yet. If not, then CPU 50 in a step ST52 checks whether the DIP switch S2 is on. If a preset number of big bonus games have been played already, then a step ST53 causes the 2-digit LEDs 14*a* to blink to show the number of big wins acquired. If the DIP switch S2 is off, then a step ST54 turns off the 2-digit LEDs 14*a*.

Figure 10:
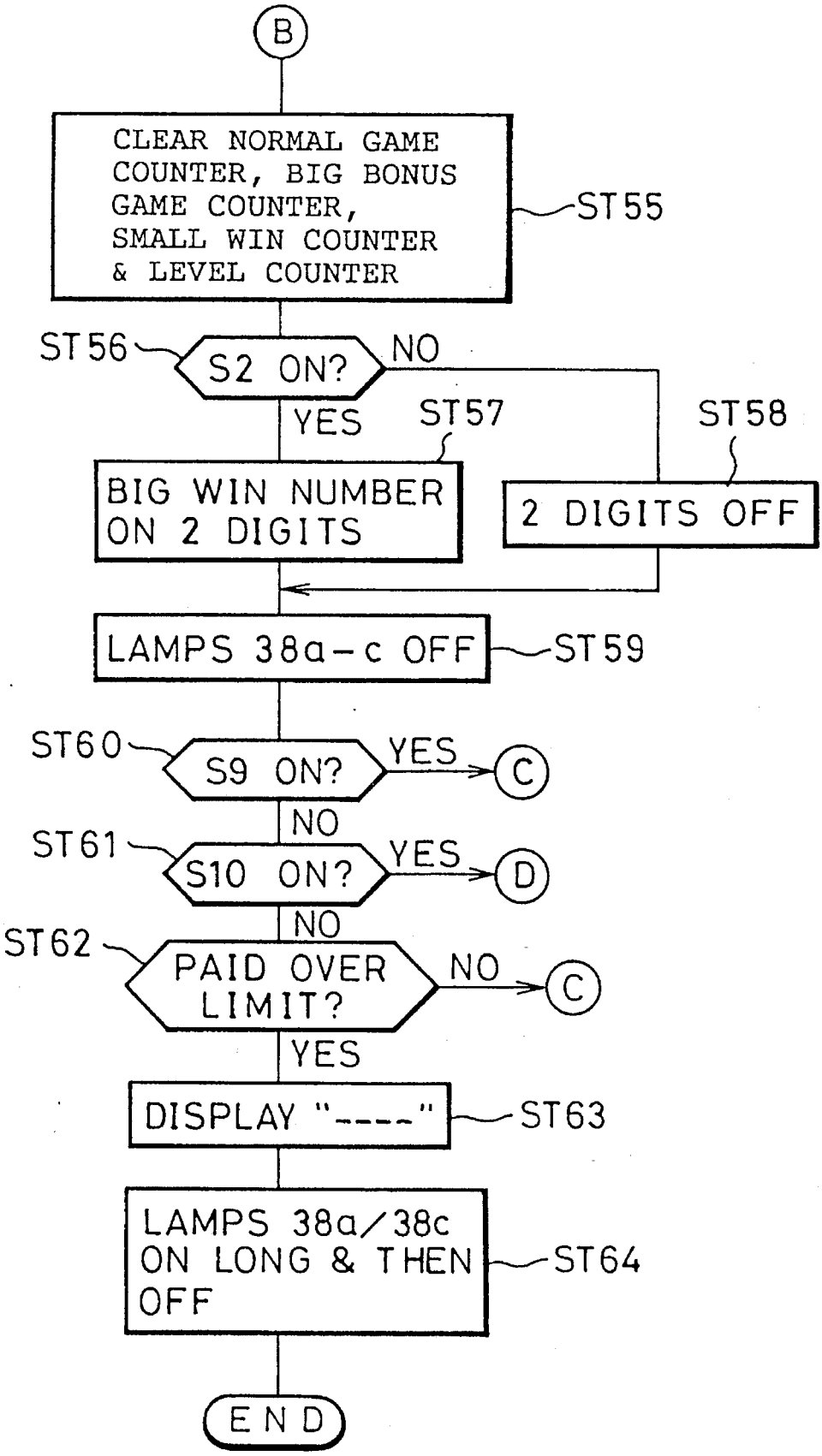

If step ST51 judges that big bonus games of the preset number have been already played, then the big win routine takes place as in FIG. 10. A step ST55 clears or resets to zero the normal game counter 55*b*, the small win counter 55*d*, and the advantage level counter, to give them a count value "zero". CPU 50 in a step ST56 checks whether the DIP switch S2 is on. If it is, then a step ST57 displays the big win number on the 2-digit LEDs 14*a*. If the DIP switch S2 is off, then a stepm ST58 turns off the 2-digit LEDs 14*a*. All the level lamps 38*a* to 38*c* have been actuated and blinking since the occurrence of the big win. A step ST59 turns off the advantage level lamps 38*a* to 38*c*. Note that step ST55 to clear the counters is performed for convenience when a big win occurs after the triggering of the advantage state and when the Advantage Level is replaced by the Normal Level.

When in general such big bonus games following a big win are all played, the slot machine 3 has paid out hundreds of tokens C, and then is inhibited from operating further, automatically in response to coincidence with a preset payable maximum value. However, the display apparatus 5 is constructed to supply the slot machine 3 with a release output for releasing the slot machine 3 from the inhibition of playing further games. The conditions for generating the release output are selectable so as to be limited or not limited, and can be determined as desired by use of a combined setting of the DIP switches S9 to S14. In FIG. 10, CPU 50 in a step ST60 checks whether the DIP switch S9 is on. If it is, then a step ST65 in FIG. 11 causes the display apparatus 5 to send the release output to the slot machine 3. The 4-digit LEDs 14*b* shows the pattern in FIG. 5C or the net reward number counted in step ST49. CPU 50 in a step ST66 checks whether the DIP switch S15 is on. If it is not, then a step ST67 causes the 4-digit LEDs 14*b* to blink for several minutes, and then keeps them turned on. If the DIP switch S15 is on, then a step ST68 causes the 4-digit LEDs 14*b* to blink for several tens of seconds and then turns them off.

Referring again to FIG. 10, if it is judged in step ST60 that the DIP switch S9 is off, then CPU 50 in a step ST61 checks whether the DIP switch S10 is on. If it is not, then a paid number comparator 50*c* operates with the preset value storage 51*a* in a step ST62, and checks whether the slot machine 3 has paid tokens C in an amount equal to or more than a payable limit before the end of big bonus games associated with the big win. The payable limit is determined by a setting of the DIP switches S11 to S14. If step ST62 judges that tokens C equal to or more than the payable limit have been paid, then a step ST63 displays the pattern of a long dash "----" of FIG. 5H on the 4-digit LEDs 14*b*. In a step ST64, the advantage level lamps 38*a* and 38*c* are turned on off several minutes and then turned off. The slot machine 3 is now inhibited from operation as a result of exceeding the payable limit.

Figure 11:
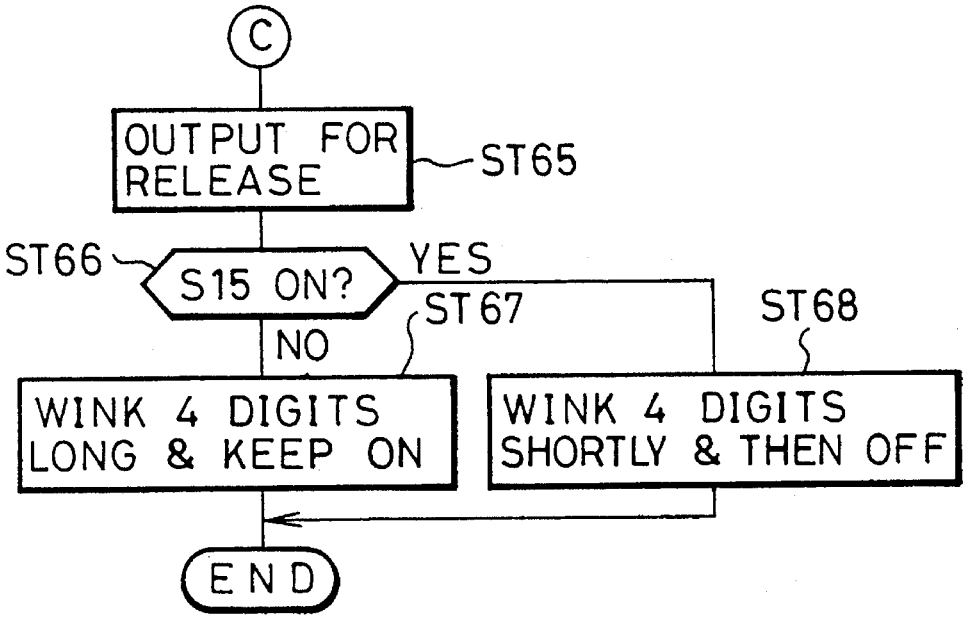
FIGS. 11 to 13 are flow charts illustrating auxiliary subroutines, initiated from the subroutine of FIGS. 9 and 10, for generating a release output.

If step ST62 judges that only tokens C less than the payable limit have been paid, then CPU 50 enters a step ST65 in FIG. 11, releases the slot machine 3 from inhibition, and permits it to continue operation. Note that the payable limit stored in the preset value storage 51*a* is selected from among various values in correspondence with the kind of the slot machine.

Figure 12:
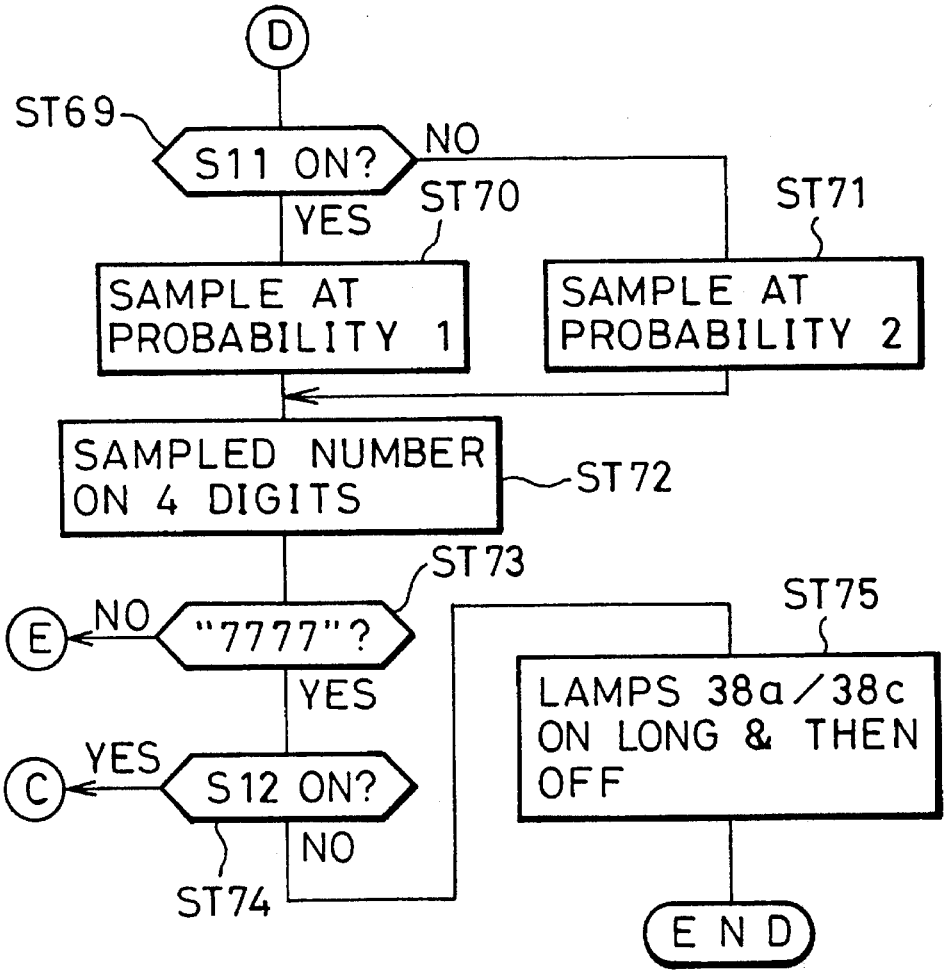

If in FIG. 10 the DIP switch S10 is judged to have been turned on in the step ST61, then CPU 50 performs the sequence shown in FIG. 12, wherein the sampling of a random number is utilized for determining the release of the slot machine 3 from inhibition. CPU 50 in a step ST69 checks whether the DIP switch S11 is on, and responsively selects one of Probability Tables 1 and 2, both of which are stored in the preset value storage 51*a*, the former of which is used in a step ST70, and the latter of which is used in a step ST71. The random number sampler 55*e* is used for sampling such a random number in conjunction with either Probability Table. A step ST72 displays the random number sampled in step ST70 or ST71 on the 4-digit LEDs 14*b*. Note that, in the course of sampling, the 4-digit LEDs 14*b* are blinked in apparently random fashion without displaying numerical information.

The paid number comparator 50*c* is a step ST73 checks whether the sampled random number on the 4-digit LEDs 14*b* coincides with the pattern of "7777" in FIG. 5D. If it does, then CPU 50 in a step ST74 checks whether the DIP switch S12 is on. If it is, then CPU 50 performs the sequence shown in FIG. 11, wherein the display apparatus 5 is used to send the release output to the slot machine 3. If the DIP switch S12 is off, then the inhibition of the slot machine 3 from operation is maintained. It is possible now to display the pattern "----" of FIG. 5H in the 4-digit LEDs 14*b* as in step ST63. Then in a step ST75, the advantage level lamps 38*a* and 38*c* are turned on for several minutes and then turned off, as an end of the present routine.

Figure 13:
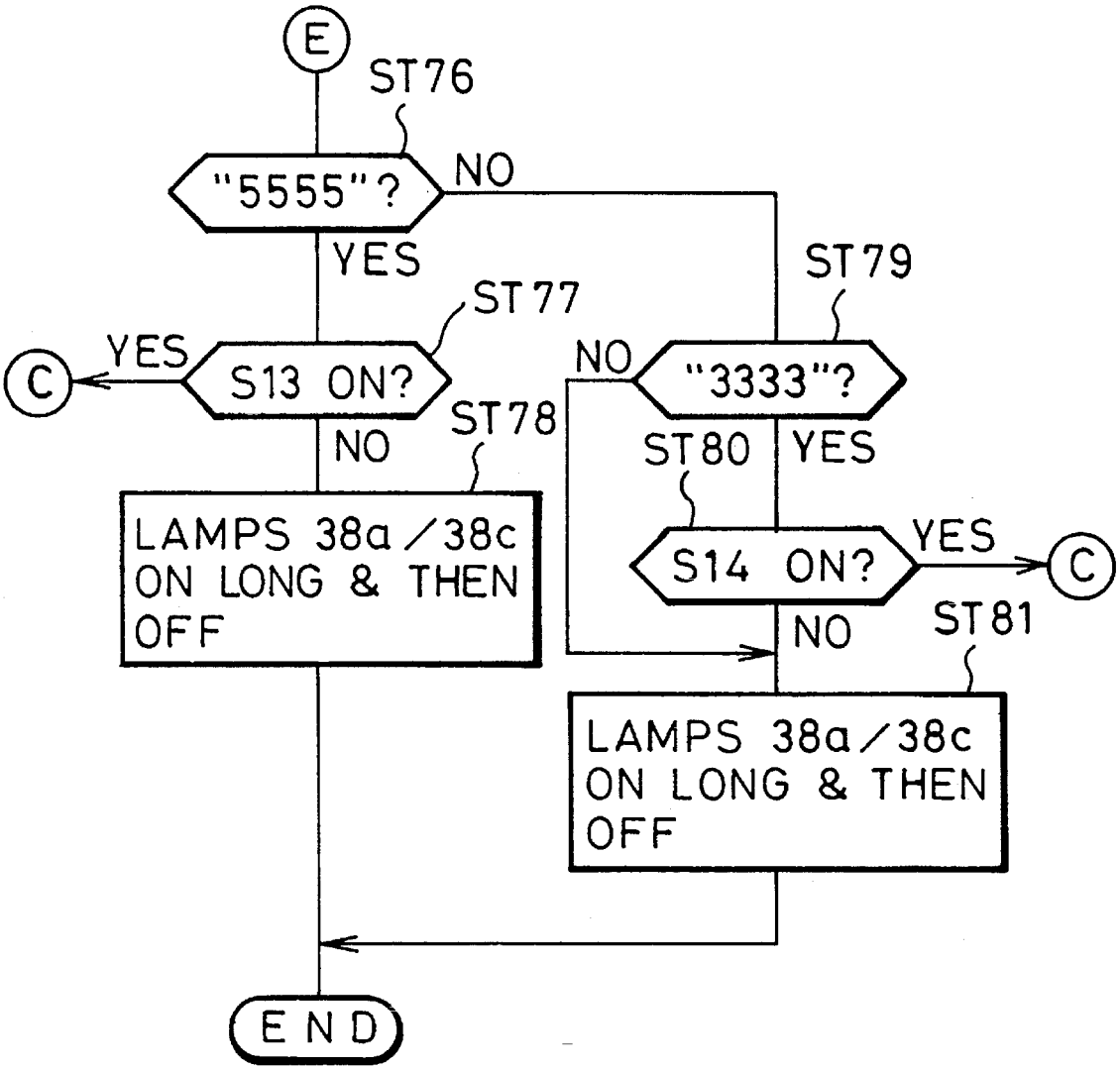

If step ST73 judges that no "7777" appears on the 4-digit LEDs 14*b*, then the CPU 50 performs the sequence of FIG. 13 from a step ST76 to a step ST81. Steps ST76 to ST78 check for coincidence with the pattern of "5555" in FIG. 5E. Steps ST79 to ST81 check for coincidence with the pattern of "3333" in FIG. 5F. Those two sequences of steps are similar to the sequence from step ST73 to step ST75.

As is described above, the net reward number after a big win can be displayed on the 4-digit LEDs 14*b*, when the release output is supplied to the slot machine 3. This is performed when DIP switch S9 is on, or when DIP switch S9 is off but DIP switch S10 on. The operation follows the settings of the DIP switches S3 and S15. If the inhibition of the slot machine 3 is retained without receiving any release output, the 4-digit LEDs 14*b* show each pattern of FIGS. 5C, 5D, 5E, 5F, 5G, and 5H. This is performed in accordance with the settings of the DIP switches S9 to S14. The lamps 38*a* and 38*c* are turned on for a period of time and then turned off, while the slot machine 3 stops operation upon reaching the payable limit.

After stopping upon reaching the payable limit, the slot machine 3 must be supplied with a release output by the managing computer 60, or be operated manually by the staff of the gaming hall, before the slot machine 3 can resume play.

Figure 14:
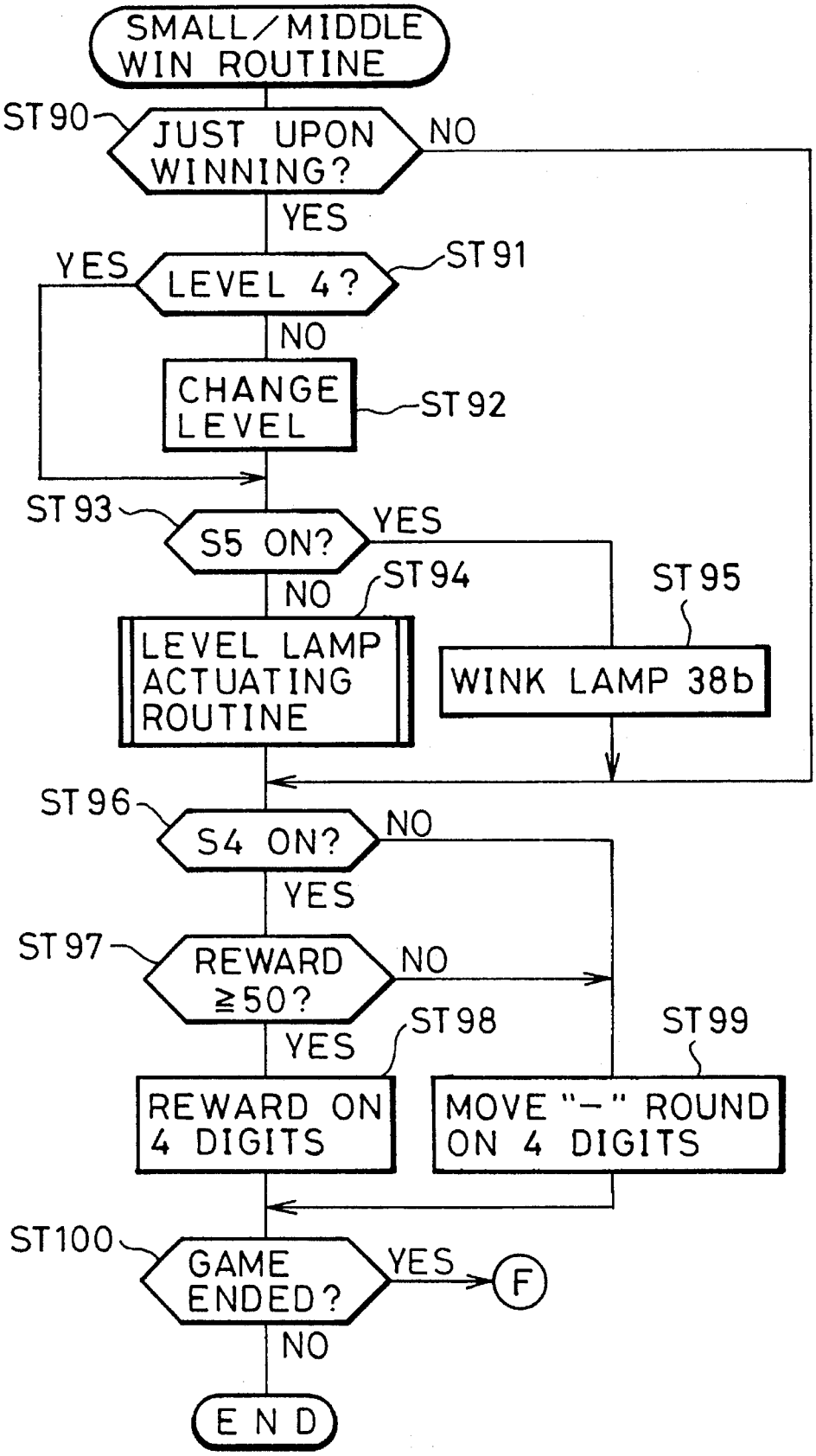
FIGS. 14 and 15 are flow charts illustrating a subroutine initiated upon a small win or a medium win.
Figure 15:
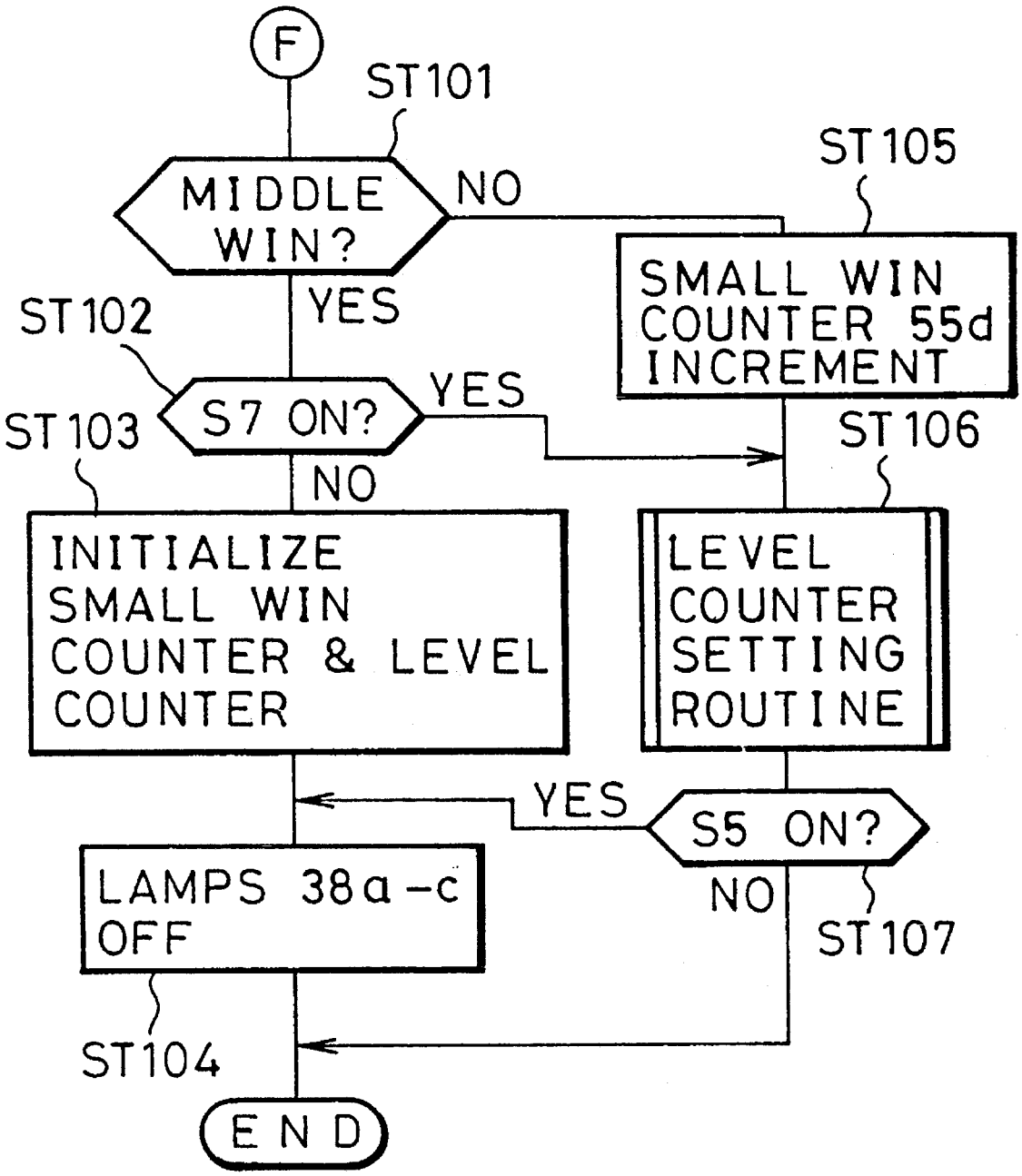

FIG. 14 illustrates the small/medium win routine, which treats not only a single win in games following a medium win, but also a small win occurring after the triggering of the advantage state. Upon the occurrence of a small win or medium win, CPU 50 in a step ST90 checks whether the small win or the medium win has been acquired only for a sufficiently short time. If it has, then CPU 50 in a step ST91 checks whether the display apparatus 5 stands at Advantage Level 4. If it does not, then CPU 50 in a step ST92 changes the Advantage Level by one level, according to the aforementioned scheme. CPU 50 in a step ST93 checks whether the DIP switch S5 is on. If it is not, then CPU 50 enters the level lamp actuating routine in a step ST94 (See FIG. 18). If the DIP switch S5 is on, then CPU 50 in a step ST95 blinks the advantage level lamp 38*b* simply for some of the Advantage Levels, but not for each Advantage Level.

Then CPU 50 in a step ST96 checks whether the DIP switch S4 is on. If it is, then a net reward number comparator 50*d* in a step ST97 checks whether a net reward is equal to or greater than a preset value, for example "50", stored in the preset value storage 51*a*. If it is, then a step ST98 displays the net reward number on the 4-digit LEDs 14*b*. If the DIP switch S4 is off or if the net reward number is less than the preset value, then a step ST99 displays the pattern of FIG. 5A, that is the sign "-" moving along the 4-digit LEDs 14*b*. CPU 50 in a step ST100 checks whether a single bonus game following a small win or a medium win has been finished. If one has not, then the present routine is ended. If one has been, then CPU 50 performs the sequence shown in FIG. 15.

CPU 50 in a step ST101 checks whether the acquired win is a medium win. If it is, then CPU 50 in a step ST102 checks whether the DIP switch 57 is on. If the acquired win is not a medium win, then a step ST103 initializes the small win counter 55*d* and causes the advantage level counter to count "zero". In a step ST104, the advantage level lamps 38*a* to 38*c* are turned off. The present routine is ended. If in step ST101 the acquired win is not judged as a medium win, then CPU 50 in a step ST105 causes the small win counter 55*d* to count incrementally. Either after the incremental counting of the small win counter 55*d* or if step ST102 judges that the DIP switch S7 is off, then CPU 50 in a step ST106 enters the advantage level counter setting routine (See FIG. 17), after which CPU 50 in a step ST107 checks whether the DIP switch S5 is on. If it is not, then the lamp 38*b* is turned off like the lamps 38*a* and 38*c*. If the DIP switch S5 is on, then the present routine is ended. The indicated Advantage Level remains.

As is described above, the DIP switch S7 is switchable between resetting or continuation of the small win counter 55*d* and the advantage level counter at the end of a sequence following a medium win. This is for the purpose of adaptability of the novel display apparatus 5 to different kinds of slot machines. In one kind, a medium win occurs while indicating the Advantage Levels. Upon the completion of sequential games following the medium win, the Advantage Level is changed to the Normal Level. The relevant counters are reset to zero, by turning off the DIP switch S7. In another kind of slot machine, a medium win again occurs while indicating the Advantage Levels. But upon the completion of the sequential games following the medium win, indication of the Advantage Levels is resumed. No resetting of the relevant counters takes place by turning on the DIP switch S7.

Figure 16:
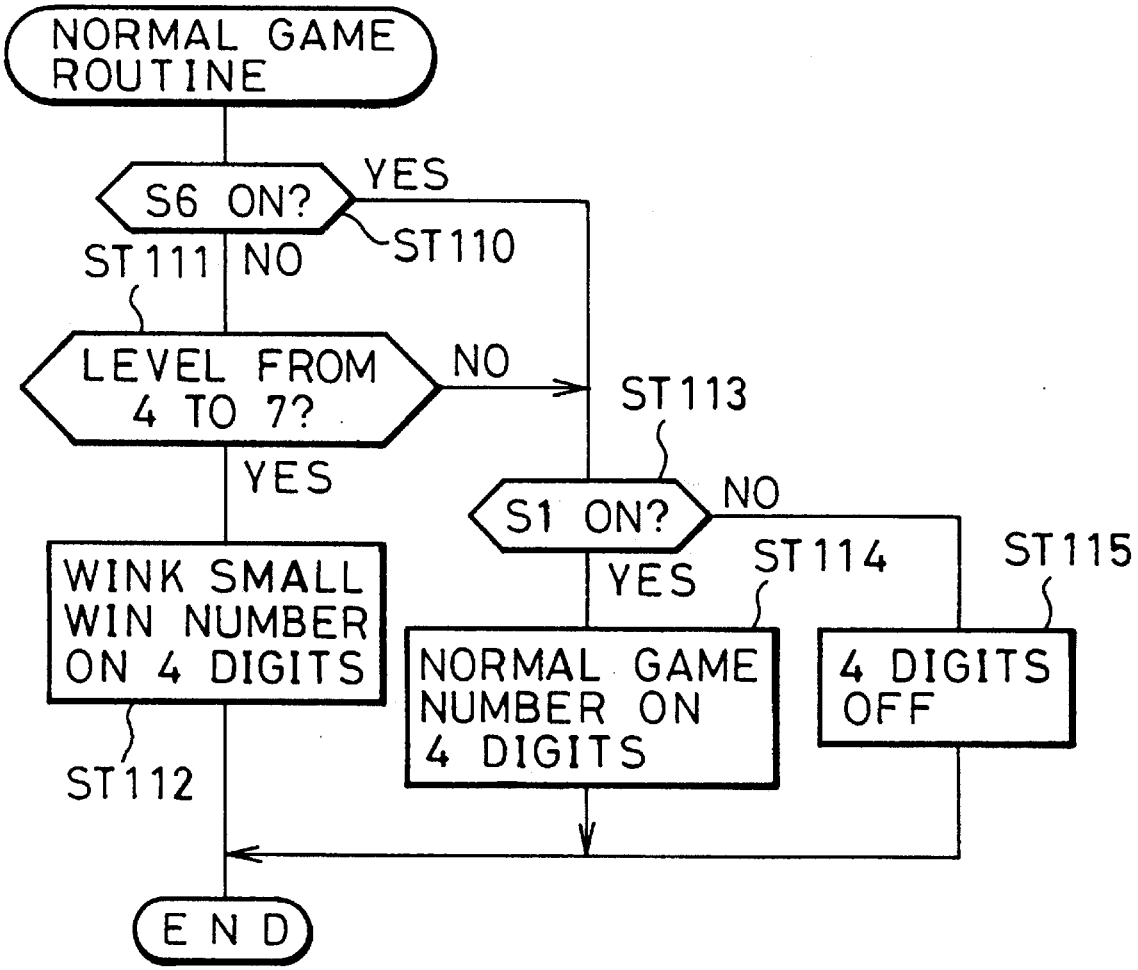
FIG. 16 is a flow chart illustrating a subroutine initiated upon a normal win.

FIG. 16 illustrates the normal game routine, which deals with lost games and games associated with normal wins such as three "PLUM"s, and also deals with normal games played after the triggering of the advantage state and not associated with a small win. CPU 50 in a step ST110 checks whether the DIP switch S6 is on. If it is not, then CPU 50 in a step ST111 checks whether the Advantage Level now is from Level 4 to Level 7. If the DIP switch S6 is on, then a step ST112 blinks the small win number on the 4-digit LEDs 14*b*. The present routine is ended. Either if the DIP switch S6 is off or if the Advantage Level now is lower than Level 4, then CPU 50 in a step ST113 checks whether the DIP switch S1 is on. If it is, then a step ST114 displays the normal game number on the 4-digit LEDs 14*b*, as a result of counting normal games since a preceding big win. If the DIP switch S1 is off, then a step ST115 keeps the 4-digit LEDs 14*b* turned off. The present routine is ended. Note that, if the DIP switch S9 is on, the 2-digit LEDs 14*a* still show a big win number at the same time, as is illustrated in step ST9 or in the flow chart of FIG. 6.

Figure 17:
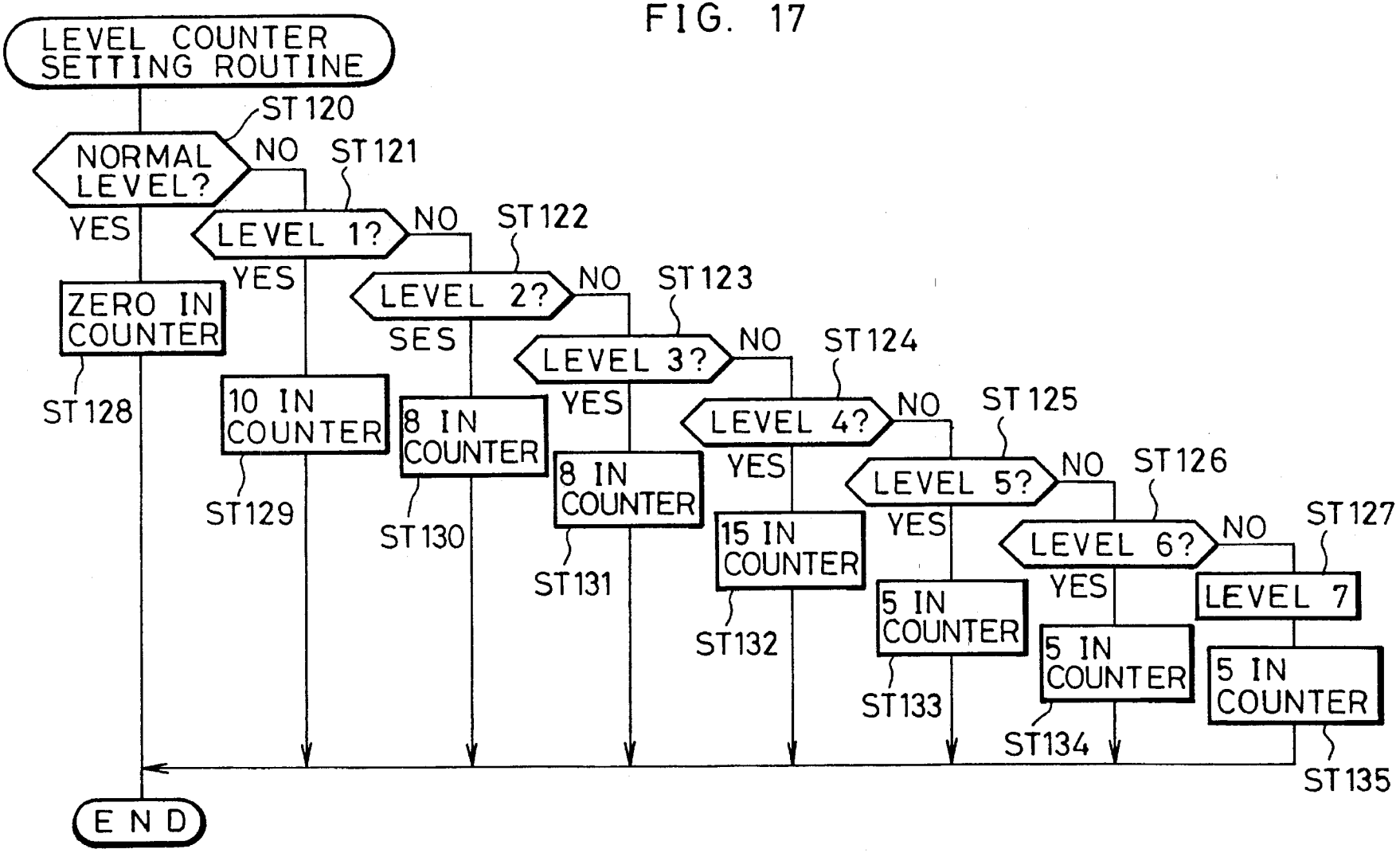
FIG. 17 is a flow chart illustrating a subroutine of setting a game-counting advantage level counter.
Figure 18:
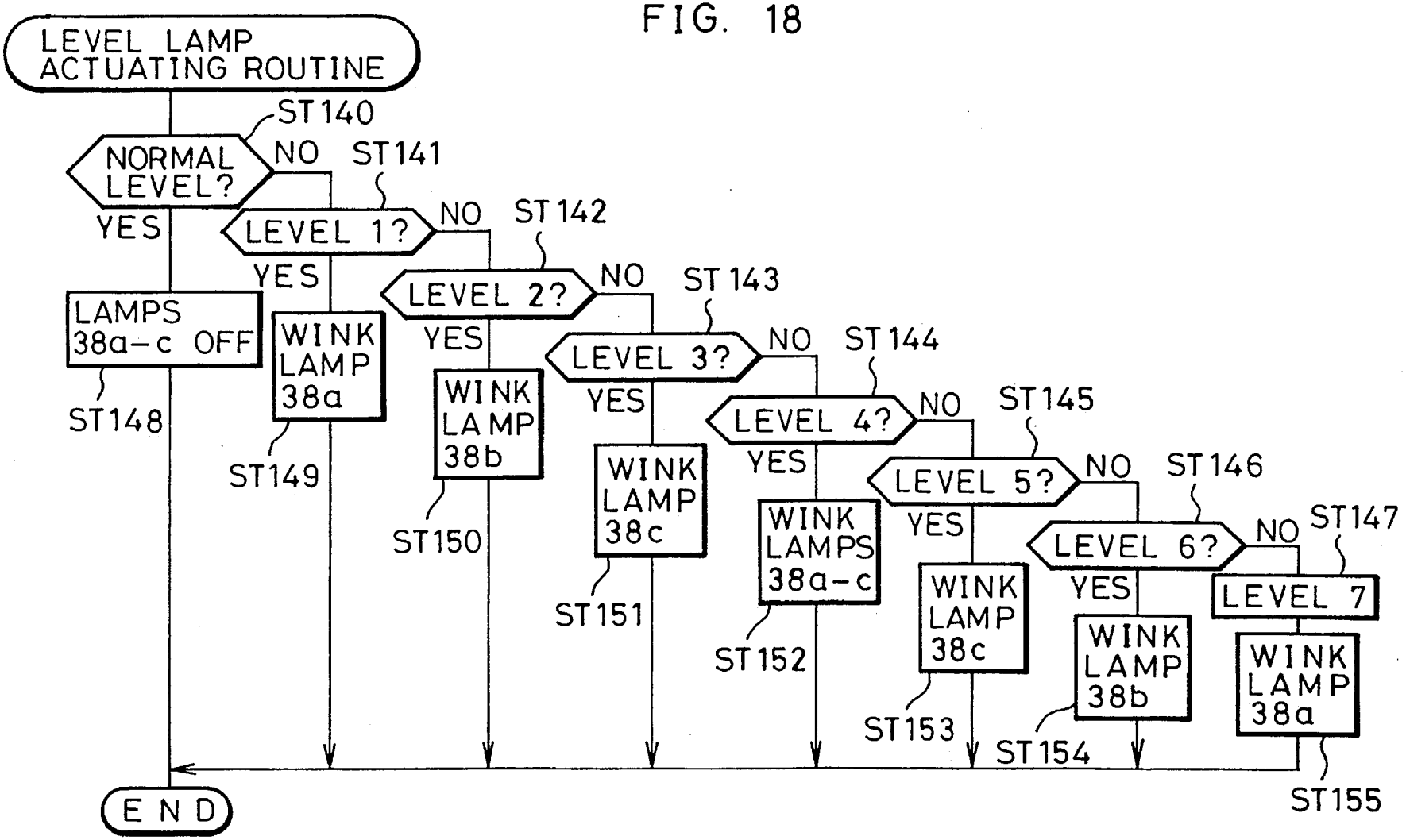
FIG. 18 is a flow chart illustrating a subroutine of actuating a set of advantage-level-indicating lamps.

FIG. 17 illustrates the advantage level counter setting routine, while FIG. 18 illustrates the advantage level lamp actuating routine. The Advantage Levels are changed in steps ST31 to ST34. The level counter setting routine determines on what occasion an Advantage Level must be changed by use of steps ST31 to ST34. The advantage level counter is set to have a number predetermined for each of the seven Advantage Levels. The advantage level counter setting routine is entered in step ST35 in FIG. 8 in the game count routine and in step ST106 in FIG. 15 in the small/medium win routine. The Advantage Level is checked in step ST91 in response to the occurrence of each small win, and in step ST111 in response to the occurrence of each normal game.

As is described above, the resetting of the advantage level counter depends on the setting of the DIP switch S7. If the DIP switch S7 is off, the level counter is reset to zero, which is useful in a slot machine wherein, upon the completion of sequential games following a medium win, the Advantage Level is changed to the Normal Level. If the DIP switch S7 is on, no resetting of the advantage level counter is performed, which is adapted to a different slot machine wherein upon the completion of the sequential games following a medium win, indication of the Advantage Levels is resumed.

CPU 50 in a step ST120 checks whether the present level of indication is the Normal Level. If it is, then CPU 50 in a step ST128 sets "zero" in the level counter. If the present level is an Advantage Level, then CPU 50 in a step ST121 checks whether the present Advantage Level is Level 1. If it is, then CPU 50 in a step ST129 sets "10" in the advantage level counter. Steps ST122 to ST127 and ST130 to ST135 operate in similar manners to set numbers in the advantage level counter in correspondence with each Advantage Level.

Figure 8:
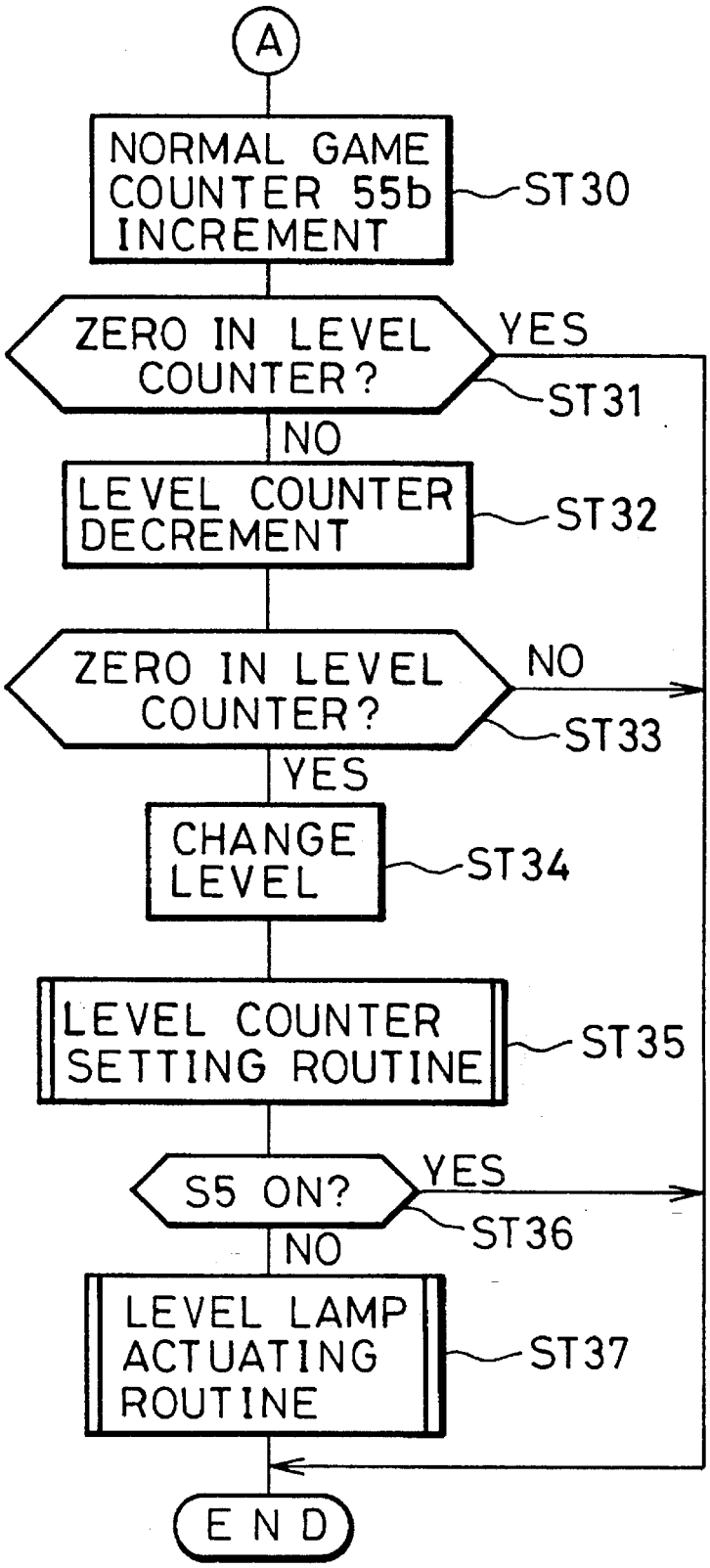

Such game numbers counted by the advantage level counter are used as limits in changing the Advantage Level in step ST34 in FIG. 8. The change of the Advantage Level depends on whether a small win occurs before the end of games of the number set in the advantage counter. Note that a medium win is followed by simple games, at the end of which the Advantage Level is judged according to the condition of the DIP switch S7 to be continued or terminated.

In the advantage level lamp actuating routine of FIG. 18, CPU 50 in a step ST140 checks whether the display apparatus 5 is at the Normal Level different from the Advantage Levels. If it is, then a step ST148 turns off the advantage level lamps 38*a* to 38*c*. This is referred to as aforementioned Light Pattern P0. If the display apparatus 5 is at an Advantage Level, then a step ST141 checks whether the Advantage Level is 1. If it its, then a step ST149 blinks the advantage level lamp 38*a*, in Light Pattern P1. If the Advantage Level is not Level 1, then CPU 50 in a step ST142 checks whether the Advantage Level is Level 2. If it is, then a step ST150 blinks the advantage level lamp 38*b* in Light Pattern P2. If the Advantage Level is not Level 2, then CPU 50 in a step ST143 checks whether the Advantage Level is Level 3. If it is, then a step ST151 blinks the advantage level lamp 38*c* in Light Pattern P3. If the Advantage Level is not Level 3, then CPU 50 in a step ST144 checks whether the Advantage Level is Level 4. If it is, then a step ST152 blinks the advantage level lamps 38*a* to 38*c* in Light Pattern P4. Similar operations are performed by steps ST145 to ST147 and ST153 to ST155.

Note that the 4-digit LEDs 14*b* display a game number and a small win number according to settings of the DIP switches S1 and S6, as shown in Table 3 and FIG. 16.

As is described above, the advantage level lamps 38*a* to 38*c* are blinked each under the control of the seven Advantage Levels. The blinking operation is preferable to simply indicating the occurrence of a big win on the display apparatus 5. It is possible for each player to recognize his or her advantages during the games in a visual manner with great ease. The player can be given great interest continuously throughout the games, without tiring of the games. The 2-digit LEDs 14*a* and the 4-digit LEDs 14*b* are effectively used for displaying the big win number and the net reward number for each of the games after a big win or after a medium win, and the net reward number after the triggering of the advantage state. The advantages of the novel display apparatus 5 thus include convenience for players as compared with conventional apparatuses.

Figure 19:
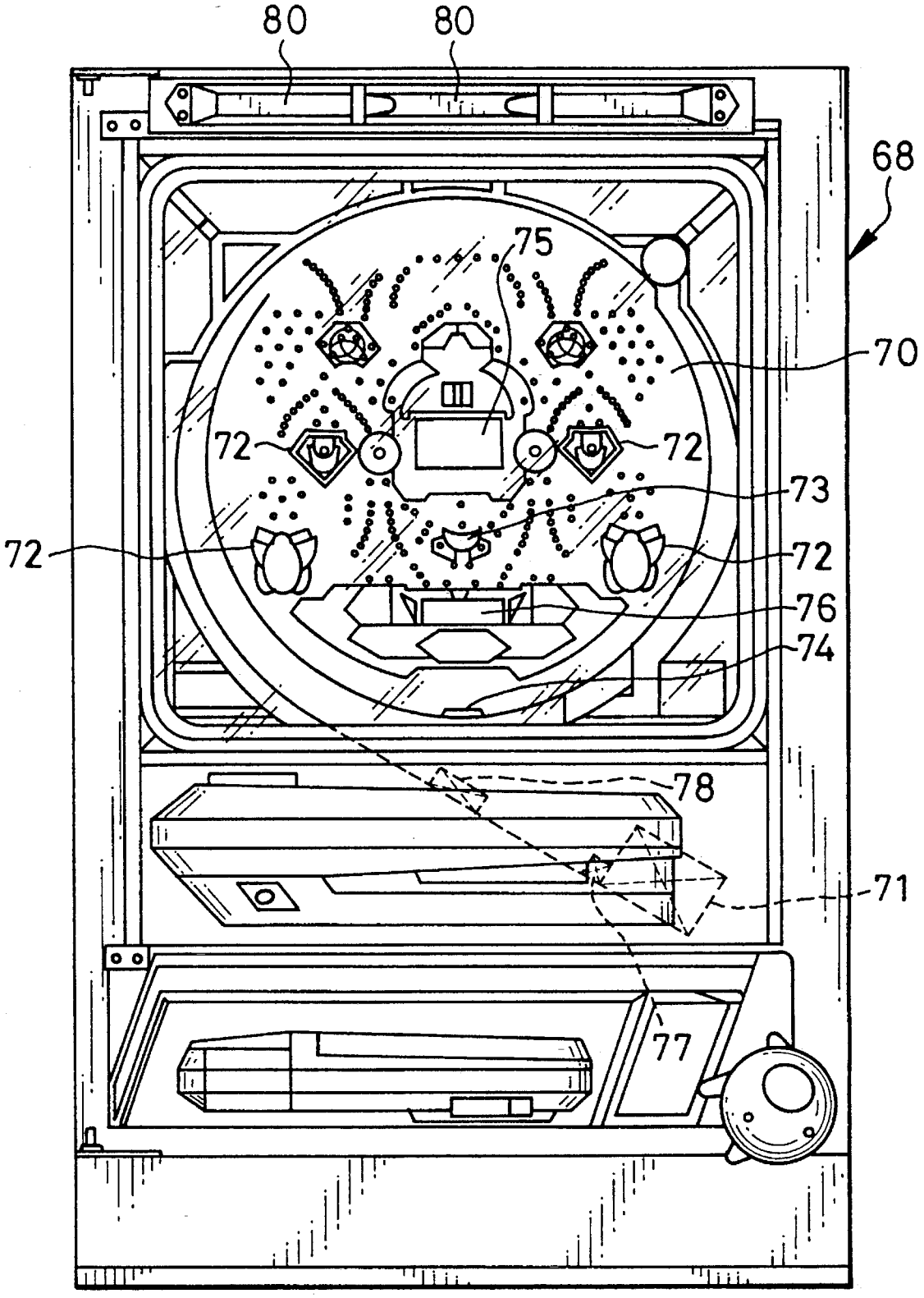
FIG. 19 is a front elevational view illustrating a pinball machine.

The following is a description of the novel display apparatus 5 adapted to a pinball machine 68 different from the slot machine 3. In FIG. 19 illustrating the appearance of the pinball machine 68 of an upright type called pachinko, a board 70 is provided with various members for guiding balls, such as nails and windmills. A shooter 71 shoots balls to be played, which fall by gravity down the front of the board 70. If a ball enters one of the minor win holes 72 or an advantage hole 73, the player acquires a win. Otherwise, the ball enters a loss hole 74 and is withdrawn by the pinball machine 68, without a win. When the ball enters the minor win hole 72, then only a predetermined number of balls are paid to the player as a prize. When the ball enters the advantage hole 73, then a bonus winning display 75 is triggered for determining whether to give the player a big win or a normal win.

The bonus winning display 75 is controlled by a microcomputer incorporated in the pinball machine 68, has three digits for numerical indication, and displays a number sampled by a scheme of determining random numbers, after being triggered and driven to show a moving pattern for a predetermined period before the fixed indication of the sampled number. The sampled number as displayed is checked whether it coincides with a specific number like "777". If it does, then the player acquires a big win, so that bonus games are played. An openable big receiver 76, called an "attacker" in the pinball machine art, is normally closed, but is operated upon the big win. The big receiver 76 is fully opened so as to receive a much greater number of balls than the minor win holes 72 and the advantage hole 73. The big receiver 76, upon the lapse of a predetermined time, is closed provisionally, then is opened again, and repeats this closing/opening movement a preset number of times. Therefore it is possible for the player to acquire a big win by way of a great number of prize balls.

The pinball machine 68 has a shot sensor 77 for detecting a ball as shot by the shooter 71, and a return sensor 78 for detecting a ball returned by gravity toward the shooter 71 when the ball has failed to run down on the board 70. The pinball machine 68 also incorporates minor win sensors and normal win sensors, respectively associated with the minor win holes 72 and the advantage hole 73, and a sensor with a counter for counting the balls to be paid out. In accordance with signals from those sensors, the pinball machine 68 outputs signals representing the numbers of balls shot at the shot sensor 77, balls returned through the return sensor 78, minor wins through the minor win holes 72, normal wins through the advantage hole 73, and paid balls as prizes, as well as a signal of occurrence of a big win. In combination with the pinball machine 68, the display apparatus 5 is used, and receives those various signals from the pinball machine 68.

There are three kinds of wins in the pinball machine 68: a minor win, a normal win, and a big win. The display apparatus 5 receives a signal of a normal win, through the normal win holes 73, as a play signal, and receives a signal of a big win given by the bonus winning display 75, as a big win signal. The 2-digit LEDs 14*a* numerically display the number of big wins that have occurred so far. The 4-digit LEDs 14*b* numerically display the number of normal wins as acquired, that is, normal wins though the advantage hole 73, but different from bonus games, acquired before each big win and after each series of bonus games. The subtracter 50*a* in CPU 50 calculates a net reward number for a bonus game played after a big win, and causes the 4-digit LEDs 14*b* to display the net reward number. The operation of obtaining the net reward is carried out by subtracting the returned ball number from the shot ball number, and then subtracting the first subtracted result from the paid ball number.

In the present embodiment, the bonus winning display 75 electrically shows numerical information. Alternatively, a bonus winning display may be constituted of a small mechanical rotary reel assembly like a slot machine. In the present embodiment, the play signal is generated in response to entry of a ball into the advantage hole 73. Note that such a play signal can have another form which supplies the display apparatus 5 with information as to the occurrence of either a normal win or a big win, such as a starting signal for driving the bonus winning display 75. If a bonus winning display includes a mechanical reel assembly, the play signal to be received by the display apparatus can be a photoelectically detectable signal representing a stopped position of the reel assembly in association with the big win, according to preset reference data of positional relationship.

The pinball machine 68 has big win lamps 80, which are actuated and blinked when a big win occurs. Note that, in the present embodiment, the big win signal is processed and generated by the microcomputer of the pinball machine 68. Alternatively a big win signal can be a photoelectic detector of light emitted by the big win lamps 80 in association with the big win.

Figure 20:
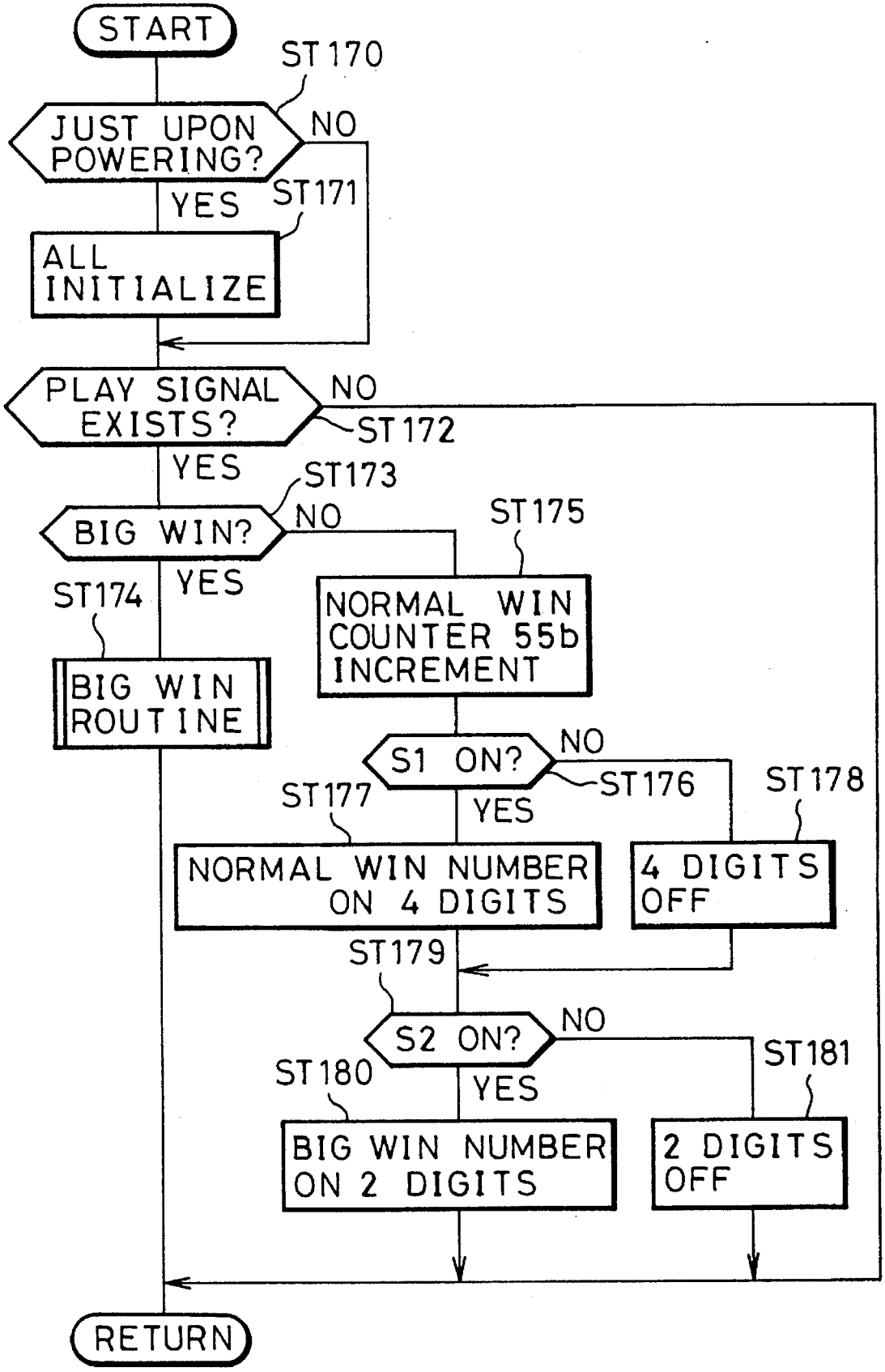
FIG. 20 is a flow chart illustrating a main routine of the display apparatus adapted to the pinball machine of FIG. 19.

FIG. 20 illustrates a main routine of the display apparatus 5 in use with the pinball machine 68. In a step ST170, CPU 50 checks whether the display apparatus 5 has been powered, or turned on, for a sufficient time. This occurs generally at the opening time of a gaming hall containing the pinball machine 68. If the display apparatus 5 has been powered for a sufficient time, then all components of the microcomputer 55 are reset to zero in a step ST171, in which various flags and data previously stored in RAM 52 are cleared. CPU 52 in a step ST172 checks whether a signal has been received from the pinball machine 68 that the ball has passed through the advantage hole 73. If not, then the game results in a minor win or a loss. The main routine is repeated. But if so, then CPU 50 in a step ST173 checks whether the games has resulted in a big win. If it has, then the microcomputer 55 in a step ST174 enters the big win routine.

If the game has not resulted in a big win, then it has resulted in a normal win. CPU 50 in a step ST175 causes the counter 55*b* to count incrementally. Note that this counter 55*b* is used as a normal win counter. CPU 50 in a step ST176 checks whether the DIP switch S1 is on. If it is, then a step ST177 displays the game number on the 4-digit LEDs 14*b*. If the DIP switch S1 is off, then a step ST178 turns off the 4-digit LEDs 14*b*. Then CPU 50 in a step ST179 checks whether the DIP switch S2 is on. If it is, then a step ST180 displays the big win number on the 2-digit LEDs 14*a*. If DIP switch S2 is off, then a step ST181 turns off the 2-digit LEDs 14*a*.

Figure 21:
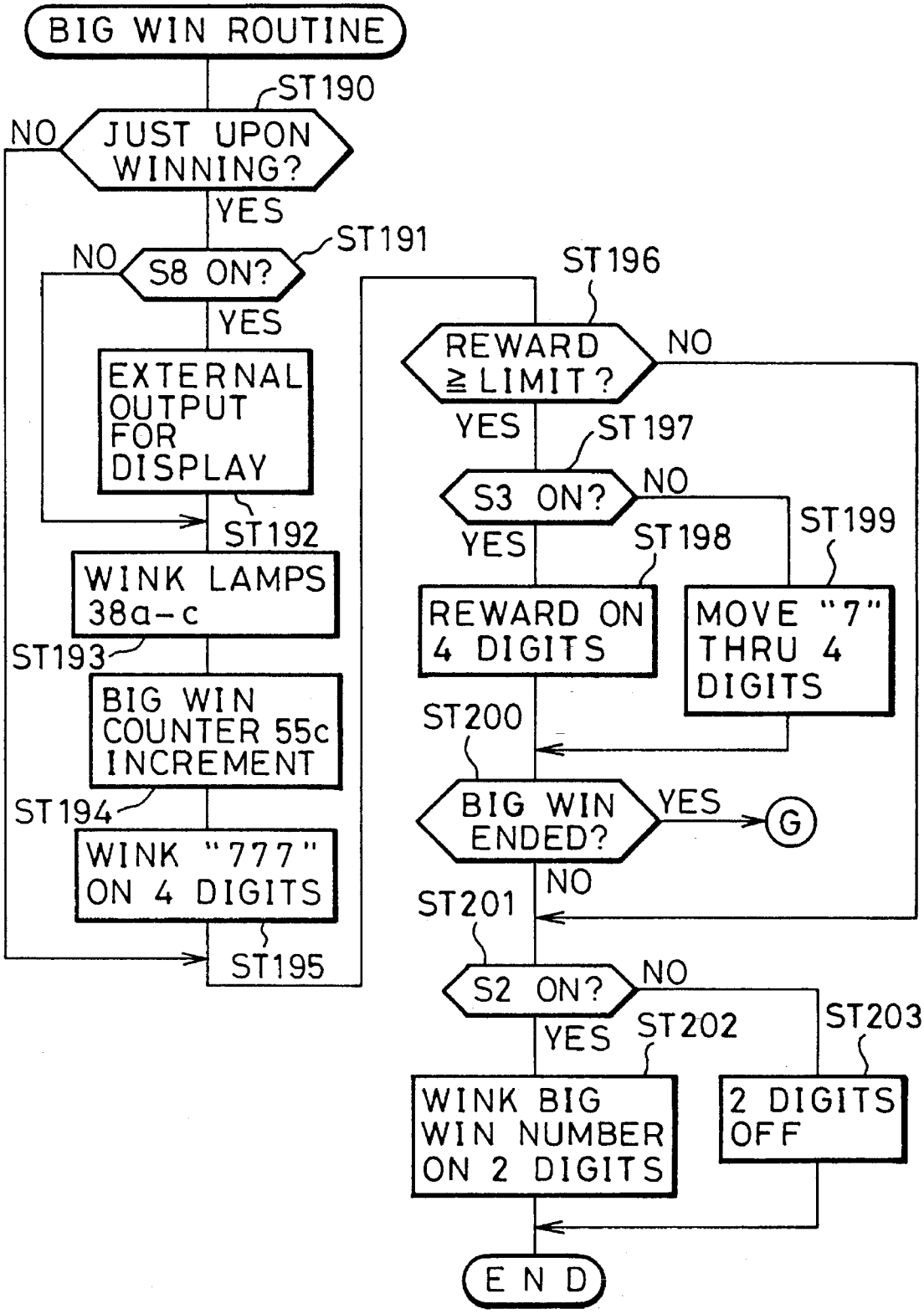
FIGS. 21 and 22 are flow charts illustrating a subroutine initiated upon a big win.
Figure 22:
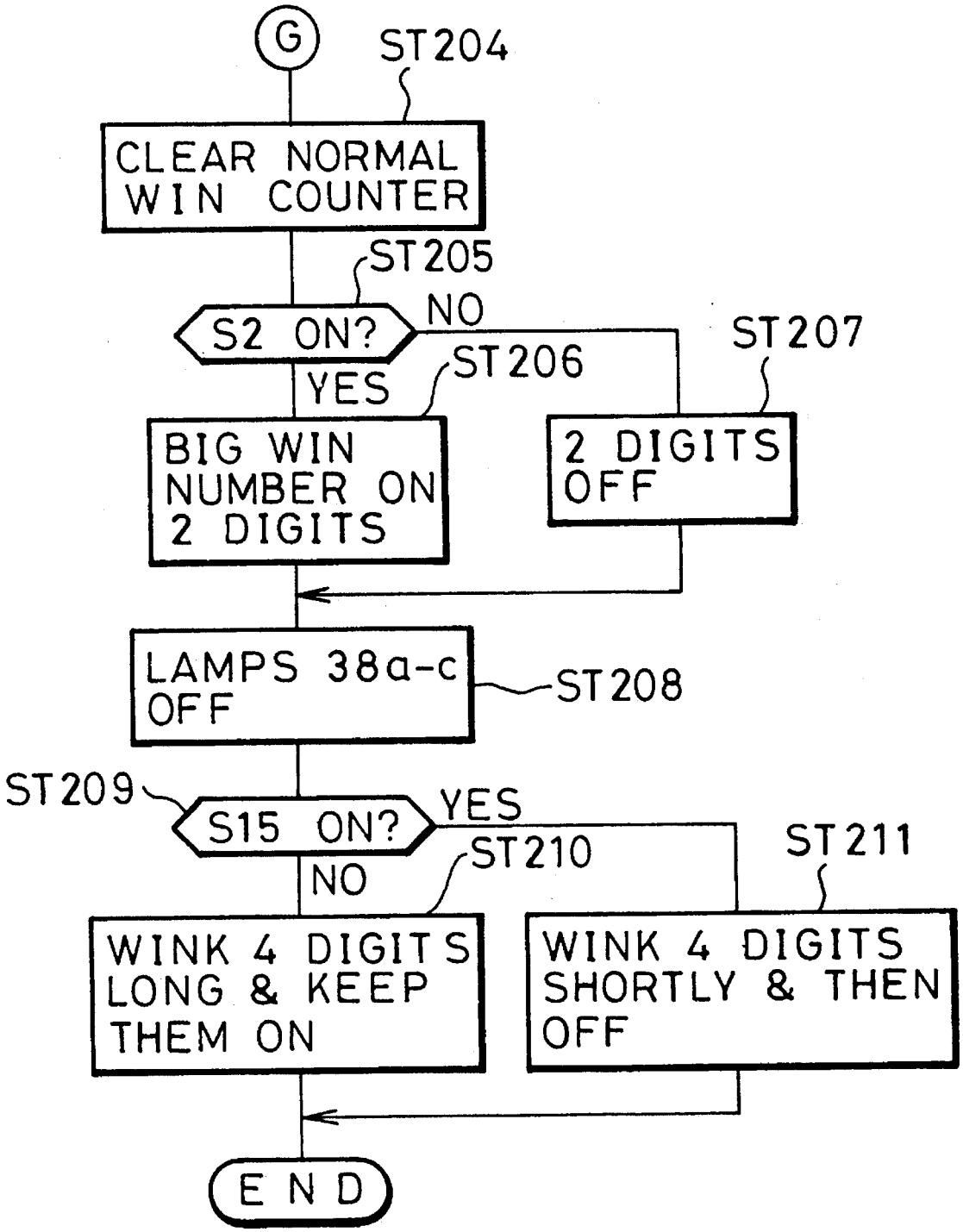

FIG. 21 illustrates the big win routine. Steps ST190 to ST195 are all the same as the steps ST40 to ST45 in FIG. 9 for the slot machine 3. In a step ST196 the net reward comparator 50*d* checks whether the subtracter 50*a* has performed a calculation to obtain a net reward number equal to or greater than a limit stored in the preset value storage 51*a*. Steps ST197 to ST203 are the same as steps ST48 to ST54. In FIG. 22, steps ST204 to ST208 are the same as steps ST55 to ST59 in FIG. 10. After step ST208 turns off the level lamps 38*a* to 38*c*, then CPU 50 in a step ST209 checks whether the DIP switch S15 is on. Steps ST209 to ST211 are the same as steps ST66 to ST68 in FIG. 11. Unlike the use of the display apparatus 5 with the slot machine 3, the routine for pinball machine 68 lacks the operation of generating a release output for the purpose of releasing the gaming machine from the inhibition of playing further games. This is because pinball machines in general are constructed without any operation of a stop upon reaching a payable limit.

As is described above, the display apparatus 5 is adaptable to any gaming machine, in which a big win different from a normal win occurs upon playing a game, and which may be either the slot machine 3 and the pinball machine 68 or another machine. When a big win occurs, relevant information can be displayed. The DIP switch array 32 is used for selecting various statuses and conditions of displaying the information as desired in the gaming hall. The display programs operating in the display apparatus 5 are partially different for the slot machine 3 and for the pinball machine 68. In the above embodiment, ROM 51 stores different programs for both machines, one of which is designated by changing over the DIP switch S16. Alternatively, the present invention can be applied to a display apparatus to which an exchangeable ROM is attached after being selected from two individually programmed ROMs. In the above embodiment comprising a pinball machine, the number of the normal wins acquired with balls through the advantage hole 73 is displayed on the 4-digit LEDs 14*b*. In addition to this, it is also preferable to construct a display apparatus capable of displaying minor wins acquired through the minor win holes 72.

In the above embodiment comprising a slot machine 3, the inserted token signal, representing the betting of each token, is counted by CPU 3*a* in the slot machine 3 which generates the inserted token number signal. Alternatively, the inserted token signal may be counted by the display apparatus to obtain the inserted token number, by receiving the inserted token signal from the slot machine 3.

In the above embodiment comprising a pinball machine 68, the shot ball signal, representing the betting of each ball, is counted by CPU 3*a* in the pinball machine 68 which generates the shot ball number signal. Alternatively, the shot ball signal may be counted by the display apparatus to obtain the shot ball number, by receiving the shot ball signal from the pinball machine 68.

In the above embodiments, the paid token signal or paid ball signal, both representing payment of each playing medium, is counted by CPU 3*a* in each gaming machine 3, 68 which generates the paid token number signal or paid ball number signal. Alternatively the paid token signal or paid ball signal may be counted by the display apparatus to obtain the numbers of the playing media that have been paid, by receiving and summing the paid token signals or paid ball signals from the gaming machine 3, 68. The returned ball signal, representing return of each shot ball, is counted, in the above embodiment by CPU 3*a* in the pinball machine 68 which generates the returned ball number signal, but alternatively may be counted by the display apparatus to obtain such numbers of balls as have been returned, by receiving the returned ball signal from the pinball machine 68.

In the above embodiments, the playing media in use with the gaming machines 3, 68 are tokens and balls. However, the present invention is further applicable to such gaming machines in which a prepaid card is used. Such a prepaid card as sold has magnetic data representing values available as play medium, and is inserted into the chosen gaming machine in such a manner that a bet for playing each game is subtracted from the initially stored data, and that prizes given to a card-using player are added to and stored in the card as acquired value.

In the above embodiments, ROM 51 in the display apparatus 5 has the preset value storage 51*a*. Alternatively a novel display apparatus can have a set of buttons or other externally operable members, which can be associated with CPU 50, and can be operated for manually inputting desired values instead of the values preset in the storage 51*a*.

In the above embodiment with the slot machine 3 having an advantage state and a normal state, the display apparatus 5, after indicating one of the Advantage Levels, returns to an indication of the Normal Level, but in a fashion irrespective of the return of the slot machine 3 to the normal state from the advantage state. Alternatively, a novel display apparatus can be so constructed that it can return to indication of the Normal Level automatically in response to a return of the slot machine 3 to the normal state from the advantage state.

Although the present invention has been fully described by way of the preferred embodiments thereof with reference to the accompanying drawings, various changes and modifications will be apparent to those having skill in this field. Therefore, unless these changes and modifications depart from the scope of the present invention as determined by the appended claims, they should be construed as being included therein.

What is claimed is:

1. In a display apparatus selectively adaptable to a plurality of kinds of gaming machines in which a playing medium is bet to play a game, said display apparatus giving an external display of information regarding conditions of said gaming machine, said gaming machine paying playing media when said game results in a win, said win comprising a normal win and at least one kind of specific win for which more playing media are paid than for said normal win, said game comprising a normal game and at least one kind of bonus game of which the probability of winning is set higher than that of said normal game, said bonus game being triggered when said specific win is acquired, said gaming machine generating a play signal representing a play of said game and a specific win signal representing said specific win; the improvement wherein said display apparatus comprises:

display means for displaying said information;

memory means provided with at least one display program stored therein particular to a selected kind of said plurality of kinds of gaming machines and accessed to drive said display means;

switch means disposed in switchable fashion for signaling switched information regarding said gaming machine, said switch means comprising a plurality of separately actuable switches, a status of said plurality of switches determining the information to be displayed on said display mean and determining which of said at least one display program is to be accessed to drive said display means; and control means, supplied with said play signal and said specific win signal, for executing said display program, said control means including a first counter section for counting the times said normal game is played between the end of playing said bonus game and the occurrence of said specific win, and a second counter section for counting the times said specific win occurs, said control means being supplied with said switched information from said switch means, and causing said display means responsively to display the number of said times of said normal game and the number of said times of said specific win.

2. A display apparatus as defined in claim 1, wherein:

said gaming machine further generates a bet signal representing betting of said playing medium, and a paying signal representing payment of said playing medium;

said control means further includes a calculating section for calculating a net reward number of playing media rewarded by said gaming machine, in accordance with said bet signal and said paying signal; and while playing said bonus game, said control means causes said display means to display said net reward number.

3. A display apparatus as defined in claim 2, wherein said play signal comprises said bet signal.

4. A display apparatus as defined in claim 1, wherein said win of said game further comprises a minor win, and said play signal is generated in response to the occurrence of said normal win and in response to the occurrence of said specific win.

5. A display apparatus as defined in claim 4, wherein:

a result of said game, in selection between said normal win and said specific win, is determined according to probability in said gaming machine; and a result of said game, in selection among a loss, said minor win, and said normal or specific win, is determined by motion of said play medium in said gaming machine.

6. A display apparatus as defined in claim 1, wherein upon completion of said bonus game and return to said normal game, said first counter section is cleared.

7. A display apparatus as defined in claim 1, wherein said control means further includes a third counter section for counting successive times of playing said bonus game.

8. A display apparatus as defined in claim 7, wherein:

said control means checks whether said specific win signal is generated when supplied with said play signal;

if no specific win signal is generated, said first counter section is stepped incrementally while judging whether said game associated with said play signal is said normal game; and if said specific win signal is generated, said third counter section is stepped incrementally while judging whether said game associated with said play signal is said bonus game.

9. A display apparatus as defined in claim 7, wherein said control means further includes:

a minimum setting section for setting a minimum number of said times of said bonus game to be displayed; and a comparing section for comparing said minimum number with said bonus game number counted in said third counter section, and if said bonus game number is less than said minimum number, said display means is inhibited from displaying said net reward number.

10. A display apparatus as defined in claim 2, wherein said control means further includes:

a minimum setting section for setting a minimum value of said net reward number to be displayed; and a comparing section for comparing said minimum value with said net reward number calculated in said calculating section, and if said net reward number is less than said minimum value, said display means is inhibited from displaying said net reward number.

11. A display apparatus as defined in claim 2, wherein:

when the play of said bonus game is finished, said gaming machine inhibits further playing of any game; and when the play of said bonus game is finished, said control means supplies said gaming machine with a release output, and releases said gaming machine from said inhibition, to permit said gaming machine to play a further game.

12. A display apparatus as defined in claim 11, wherein said control means further includes:

a maximum setting section for setting a maximum number of playing media payable from said gaming machine; and a comparing section for comparing said maximum with the number of playing media paid from said gaming machine, and if said number of said media is more than said maximum, said control means is inhibited from supplying said release output.

13. A display apparatus as defined in claim 11, wherein said control means further includes:

a random number generator section for generating a random number;

a section for setting one target number; and a comparing section for comparing said random number with said target number, and if said random number is different from said target number, said control means is inhibited from supplying said release output.

14. A display apparatus as defined in claim 2, wherein:

said win of said game further comprises a small specific win for which fewer playing media are paid than for said specific win;

said gaming machine playing said normal game has a normal state and an advantage state, such that said normal game when played in said advantage state has a higher probability of resulting in said small specific win than when played in said normal state; and display means indicating the existence of said advantage state.

15. A display apparatus as defined in claim 14, wherein:

said control means further includes a fourth counter section, supplied with a signal representing said small specific win, for counting the number of times of the occurrence of said small specific win; and said control means is supplied from said gaming machine with a signal representing a triggering of said advantage state, and responsively causes said display means to display the number of said times of said small specific win.

16. A display apparatus as defined in claim 15, wherein said display means displays said net reward number in response to said triggering of said advantage state.

17. A display apparatus as defined in claim 2, wherein said control means further includes:

a minimum setting section for setting a minimum value of said net reward number to be displayed; and a comparing section for comparing said minimum value with said net reward number calculated in said calculating section, and if said net reward number is less than said minimum, said display means is disabled from displaying said net reward number.

18. A display apparatus as defined in claim 14, wherein if no small win occurs before a preset number of times of playing said game following said triggering of said advantage state, said display means is inhibited from indicating said triggering of said advantage state.

19. A display apparatus as defined in claim 18, which after said triggering of said advantage state has at least two levels different in inhibition from indicating said triggering of said advantage state, and said display means indicates said different levels selectively.

20. A display apparatus as defined in claim 19, wherein said advantage state is triggered in said gaming machine in accordance with probability.

* * * * *